US008863965B2

(12) United States Patent
Davison et al.

(10) Patent No.: US 8,863,965 B2
(45) Date of Patent: Oct. 21, 2014

(54) BOOM WITH TWO-BLOCK SENSING SYSTEM

(75) Inventors: Timothy J. Davison, Mason City, IA (US); Jeramy R. Voortmann, Clear Lake, IA (US); Matthew W. Schroeder, Ventura, IA (US)

(73) Assignee: Stellar Industries, Inc., Garner, IA (US)

( * ) Notice: Subject to any disclaimer, the term of this patent is extended or adjusted under 35 U.S.C. 154(b) by 288 days.

(21) Appl. No.: 13/310,343

(22) Filed: Dec. 2, 2011

(65) Prior Publication Data

US 2013/0140259 A1 Jun. 6, 2013

(51) Int. Cl.
*B66C 13/18* (2006.01)

(52) U.S. Cl.
USPC ..... 212/281; 212/276

(58) Field of Classification Search
CPC ..... B66C 13/50; B66C 13/00; B66C 13/18; B66C 23/90; B66C 23/905
USPC ..... 212/281, 276; 340/685
See application file for complete search history.

(56) References Cited

U.S. PATENT DOCUMENTS 3,922,789 A 12/1975 Sarrell
2012/0241403 A1* 9/2012 Ethington ..... 212/281

OTHER PUBLICATIONS

Stellar Industries, Inc., Model 5521 Telescopic Crane Owners' Manual, 2011, pp. 1-37.

* cited by examiner

*Primary Examiner* — Emmanuel M Marcelo
*Assistant Examiner* — Angela Caligiuri
(74) *Attorney, Agent, or Firm* — Camille L. Urban; David M. Breiner; G. Brian Pingel

(57) ABSTRACT

Provided is a two-block sensing system (or device) that may be attached to an end of a lifting device, for example, a crane. The sensing device may include an A2B mount, a touch bar pivotally connected to the A2B mount, a link pivotally connected to the A2B mount, and a switch operatively connected to the touch bar so that if the touch bar is rotated with respect to the A2B mount, the switch becomes one of activated and deactivated.

23 Claims, 20 Drawing Sheets

BOOM WITH TWO-BLOCK SENSING SYSTEM

BACKGROUND

1. Field

Example embodiments relate to a two-block sensing system and more particularly a two-block sensing system attached to an end of a lifting device, for example, a crane.

2. Description of the Related Art

A crane, in its most basic form, is a machine for raising and lowering objects, and, while holding them suspended, transporting them through a limited lateral distance. In one form it consists of a projecting arm or jib or boom of timber or iron, a rotating post or base, and the necessary tackle, windlass, etc. The arm or jib or boom includes an end. This end is where cables, which are attached to a load, are threaded through a pulley block or sheaves. This end of the boom is what is referred to by many in the industry as the "horsehead"; this reference is for obvious visual reasons.

In a conventional crane, a first pulley block is arranged in the horsehead. A cable threaded through the first pulley block is also threaded through a second pulley block (known in the industry as a "snatch block") which is associated with a hook. In the conventional art, the pulley block of a hook may be moved towards the horsehead. For example, when the boom telescopes outward (or is lowered) the pulley block associated with the hook will be pulled towards the horsehead. Alternatively, the hook's pulley block may be pulled towards the horsehead via an activation of a winch. A "two-block" condition occurs when the hook's pulley block runs into the boom's pulley block. Such a condition is to be avoided as the two-block condition may result in damage to the crane and/or its components. For example, in the event the hook's pulley block runs into the boom's pulley block, the cable could be snapped.

In the conventional art, two-block sensors are arranged at the horsehead in order to detect whether a collision between the hook's pulley block and the horsehead's pulley block is imminent. In the event the two-block sensors detect that a collision is imminent, the two-block sensors cause various operations of the crane to stop. For example, in some conventional cranes, the two-block sensor may cause the winch to cease operating.

SUMMARY

Example embodiments relate to a two-block sensing system (or device) and more particularly a two-block sensing system (or device) attached to an end of a crane.

In accordance with example embodiments, a sensing device may include an anti two-block (A2B) mount, a touch bar pivotally connected to the A2B mount, a link pivotally connected to the A2B mount to link the A2B mount to a support structure, and a switch operatively connected to the touch bar so that if the touch bar is rotated relative to the A2B mount, the switch becomes one of activated and deactivated.

In accordance with example embodiments, a crane may include a horsehead on an end of a boom and a sensing device on the horsehead. In example embodiments, the horsehead may be configured to flip from a first position to at least one other position. In example embodiments, the sensing device may include an A2B mount, a link, and a touch bar, wherein the A2B mount is movably connected to the horsehead, the touch bar is movably connected to the A2B mount, and the link is movably connected to the A2B mount and to the end of the boom.

In accordance with example embodiments, a kit for retrofitting a crane having a horsehead may include an A2B mount, at least one link configured to attach to the A2B mount, a touch bar configured to attach to the A2B mount, a biasing device configured to attach to the A2B mount and the touch bar, and a switch.

BRIEF DESCRIPTION OF THE DRAWINGS

Example embodiments are described in detail below with reference to the attached drawing figures, wherein.

DETAILED DESCRIPTION

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments of the invention relate to a horsehead movable between at least two positions with a two-block sensing system mounted thereon.

Figure 1:
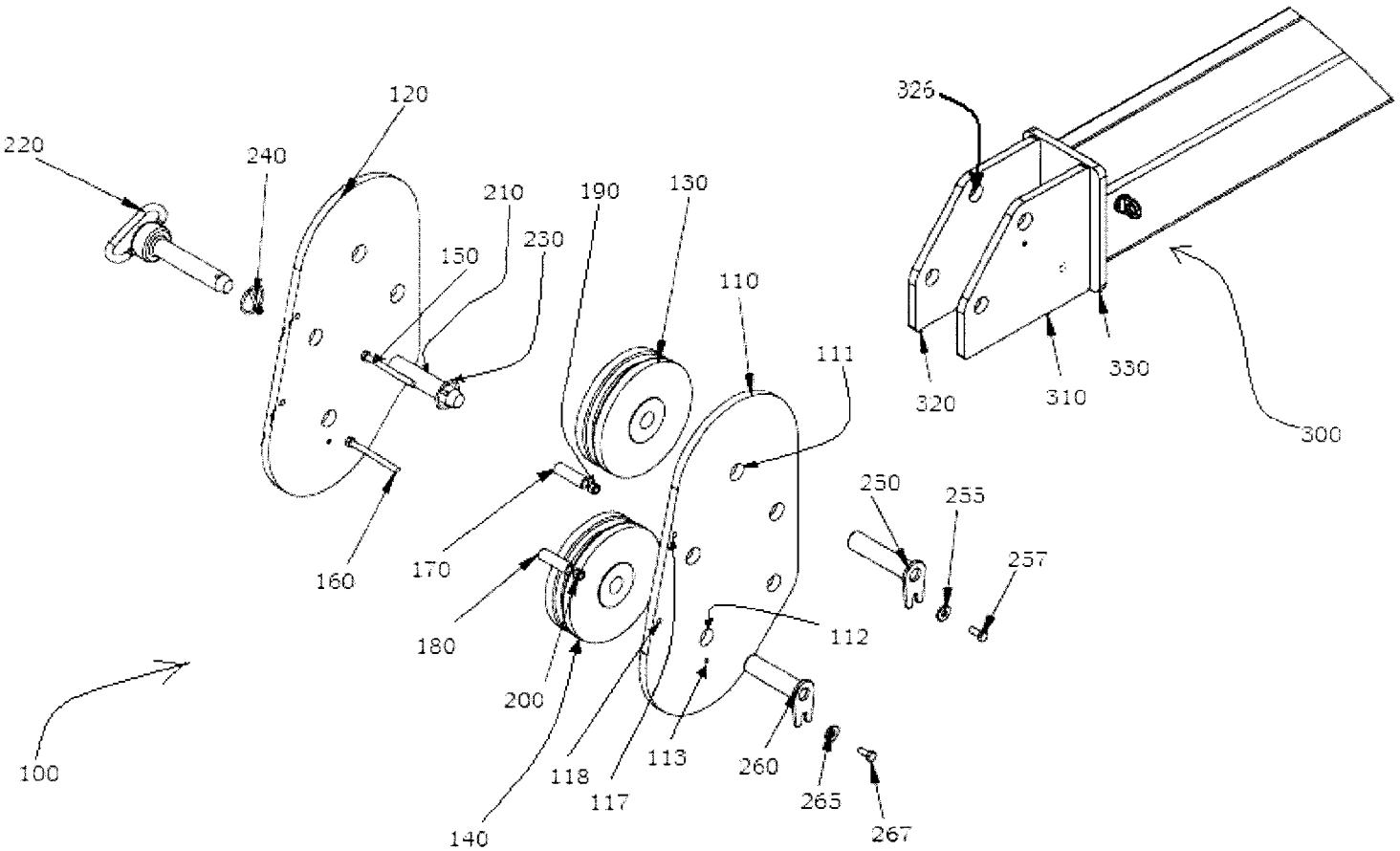
FIG. 1 is an exploded view of a horsehead, in accordance with example embodiments.

FIG. 1 is an exploded view of a horsehead 100 configured to couple to an end bracket of a boom 300. The boom 300 may be a part of a telescoping boom assembly and thus may move horizontally as well as vertically. Because telescoping booms are well known in the art, a detailed description thereof is omitted for the sake of brevity.

As shown in FIG. 1, an end of the boom 300 may include an end bracket comprised of a first plate 310, a second plate 320, and a third plate 330. In example embodiments, the third plate 330 may be a substantially rectangular plate and may serve as a base plate of the end bracket. The first plate 310 and the second plate 320 may be perpendicularly attached to the third plate 330 and may be substantially parallel with one another. The first plate 310 and the second plate 320 of the end bracket may be but are not necessarily substantially identical.

Figure 2:
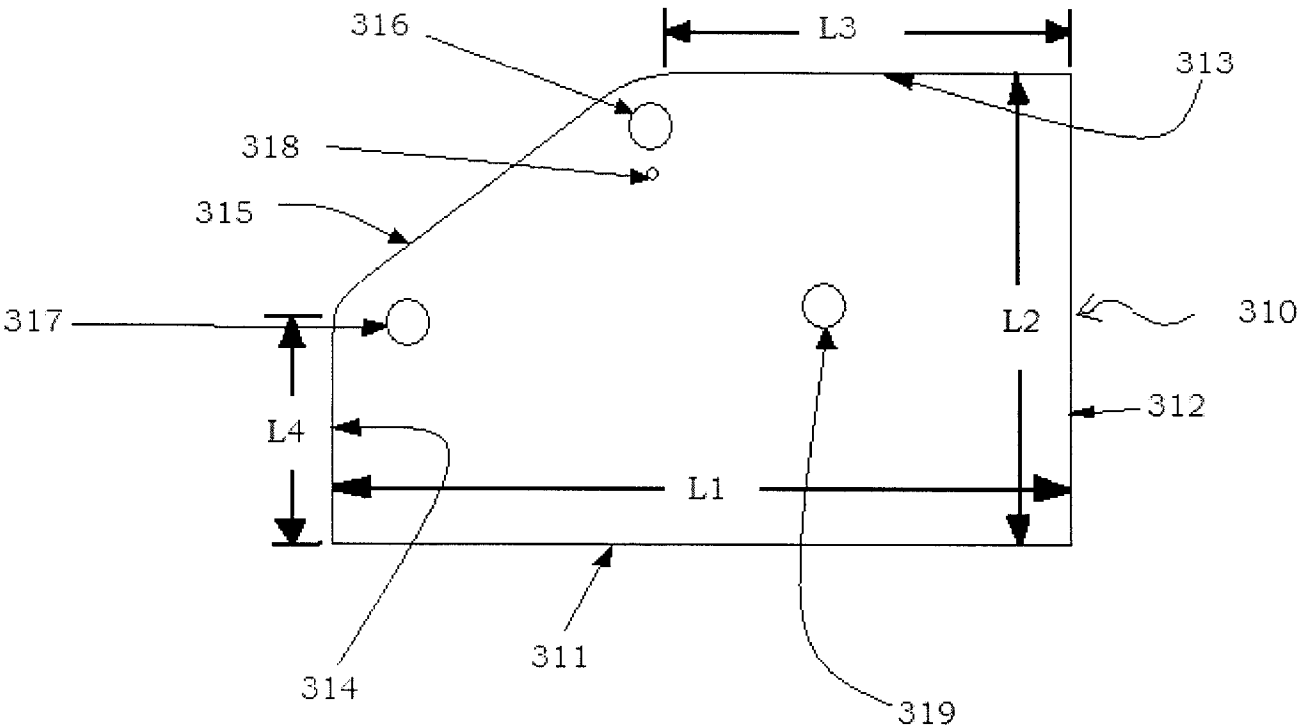
FIG. 2 is an elevation view of a first plate of a crane end bracket in accordance with example embodiments.

FIG. 2, shows an elevation view of the first plate 310. As shown in FIG. 2, the first plate 310 may be defined by five surfaces: a first surface 311, a second surface 312, a third surface 313, a fourth surface 314, and a fifth surface 315. The first surface 311, which may be a lowest surface of the first plate 310, may be a substantially rectangular horizontal surface having a first length L1 and a width generally equal to, and extending along, a thickness of the plate 310. The second surface 312 may be a substantially vertical surface relative to the first surface 311 and may extend upwards from a right side of the first surface 311. In example embodiments, the second surface 312 may have a second length L2 extending generally vertically and a thickness substantially equal to, and extending along, a thickness of the plate 310.

In example embodiments, the third surface 313 may be a substantially rectangular horizontal surface and may extend from an upper portion of the second surface 312 in a leftward direction. In example embodiments, the third surface 313 may have a width equal to, and extending along, a thickness of the plate 310. In example embodiments, a third length L3 of the third surface 313 may be smaller than the first length L1 of the first surface 311. The fourth surface 314 may be a substantially vertical surface and may extend from a left side of the first surface 311. In example embodiments, a fourth length L4 of the fourth surface 314 may smaller than the second length L2 of the second surface 312. In example embodiments, the fourth surface 314 may have a width equal to, and extending along, a thickness of the plate 310.

The fifth surface 315 may extend from an upper portion of the fourth surface 314 to the left portion of the third surface 313. Because the fourth length L4 of the fourth surface 314 may be less that the second length L2 of the second surface 312, and because the third length L3 of the third surface 313 may be less than the first length L1 of the first surface 311, the fifth surface 315 may be inclined with respect to the first surface 311. As with the first through fourth surfaces 311-314, the fifth surface may be a substantially flat surface having a width equal to, and extending along, the thickness of the plate 310.

In example embodiments, the first plate 310 may include a first hole 316, a second hole 317, a third hole 318, and a fourth hole 319. The first hole 316 may be arranged near an intersection of the third surface 313 and the fifth surface 315. As will be explained shortly, the first hole 316 may be configured to have a diameter slightly larger than a pin used to support a sheave within the horsehead 100. In example embodiments, the third hole 318 may be arranged within the vicinity of the first hole 316. As will be explained shortly, the third hole 318 may be a threaded hole and may be configured to engage threads of a cap screw that may be used to secure a tear drop pin to the first plate 310. The second hole 317 may be arranged near an intersection of the fourth surface 314 and the fifth surface 315. As will be explained shortly, the second hole 317 may be configured to accommodate a pin hitch which may be used to lock the horsehead 100 in one of a plurality of positions. The fourth hole 319 may be arranged near a middle of the plate 310. As will be explained later, the fourth hole 319 may facilitate a pin connection between a link of a two-block sensing system and the end bracket of the boom 300.

Figure 3:
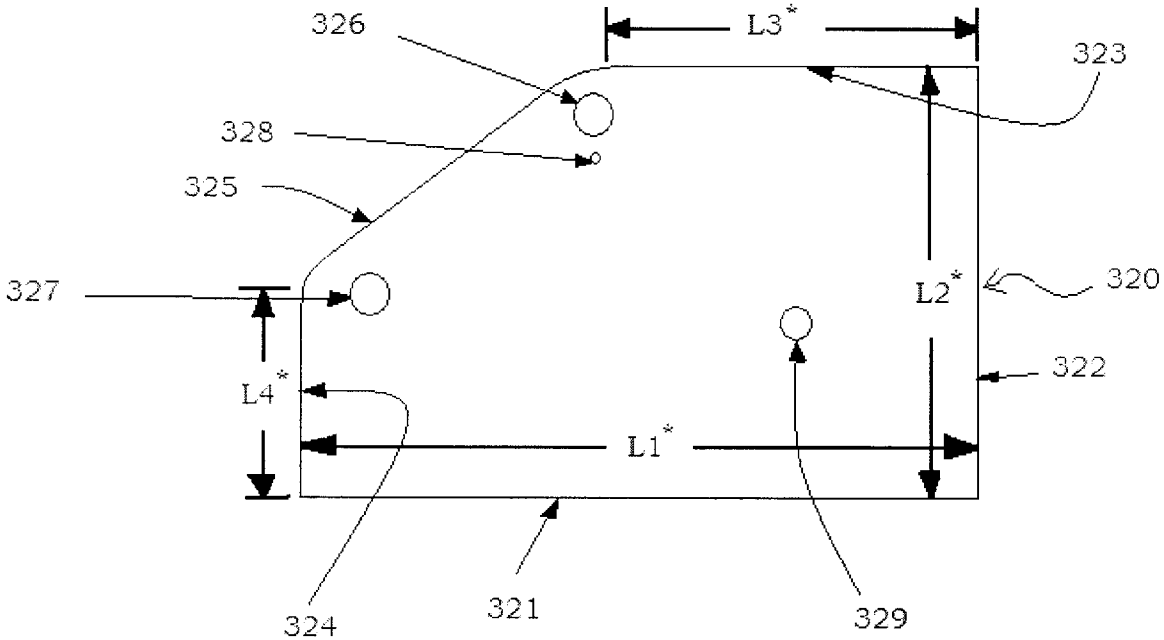
FIG. 3 is an elevation view of a second plate of the crane end bracket in accordance with example embodiments.

In example embodiments, the second plate 320, as shown in FIG. 3, of the end bracket may be substantially identical to the first plate 310. For example, the second plate 320 may be defined by a first surface 321, a second surface 322, a third surface 323, a fourth surface 324, and a fifth surface 325 that are substantially the same as the first surface 311, the second surface 312, the third surface 313, the fourth surface 314, and the fifth surface 315 of the first plate 310. Thus, a detailed description thereof is omitted for the sake of brevity. Furthermore, the second plate 320 may also include a first hole 326, a second hole 327, a third hole 328, and a fourth hole 329 which may have substantially the same size and arrangement as the first hole 316, the second hole 317, the third hole 318, and the fourth hole 319 of the first plate 310. Further yet, the second plate 320 may have the dimensions L1*, L2*, L3*, and L4* which are substantially the same as the dimensions L1, L2, L3, and L4 of the first plate 310.

In example embodiments, the first, second, and third plates 310, 320, and 330 may be attached to one another through welding thus forming an integral structure. It should be noted that the above description of the end bracket is merely descriptive and is not meant to limit the scope of the invention. For example, rather than forming an end bracket through welding of three discrete plates, the bracket may be an integral structure formed through a casting process or a combination of casting and welding. Furthermore, the shapes of the brackets are not meant to limit the scope of the invention. For example, rather than using a plate being bounded by five surfaces as illustrated in FIGS. 1-3, the plates associated with boom end bracket may have less than five surfaces defining the plate. For example, the end bracket could have a substantially rectangular shape. Alternatively, the plates of the end bracket may be defined by more than five surfaces.

Referring back to FIG. 1, the horsehead 100 includes a first sheave 130 and a second sheave 140 sandwiched between a first sheave mounting plate 110 and a second sheave mounting plate 120. The first and second sheaves 130 and 140, may, for example, have a diameter of about 6.75 inches and a thickness of about 2.0 inches. However, example embodiments are not limited to sheaves having the aforementioned dimensions and it is common for cranes to employ sheaves of sizes relative to the desired lift and load capabilities. Furthermore, there may be more than two sheaves provided between the first and second sheave mounting plates 110 and 120.

In example embodiments, the first and second sheave mounting plates 110 and 120 may be attached to one another via a plurality of pins and screws as will be described shortly. Further, in example embodiments, the first sheave mounting plate 110 may be substantially identical to the second sheave mounting plate 120. Thus, for the sake of brevity, only a detailed discussion of the first sheave mounting plate 110 will be presented.

Figure 4:
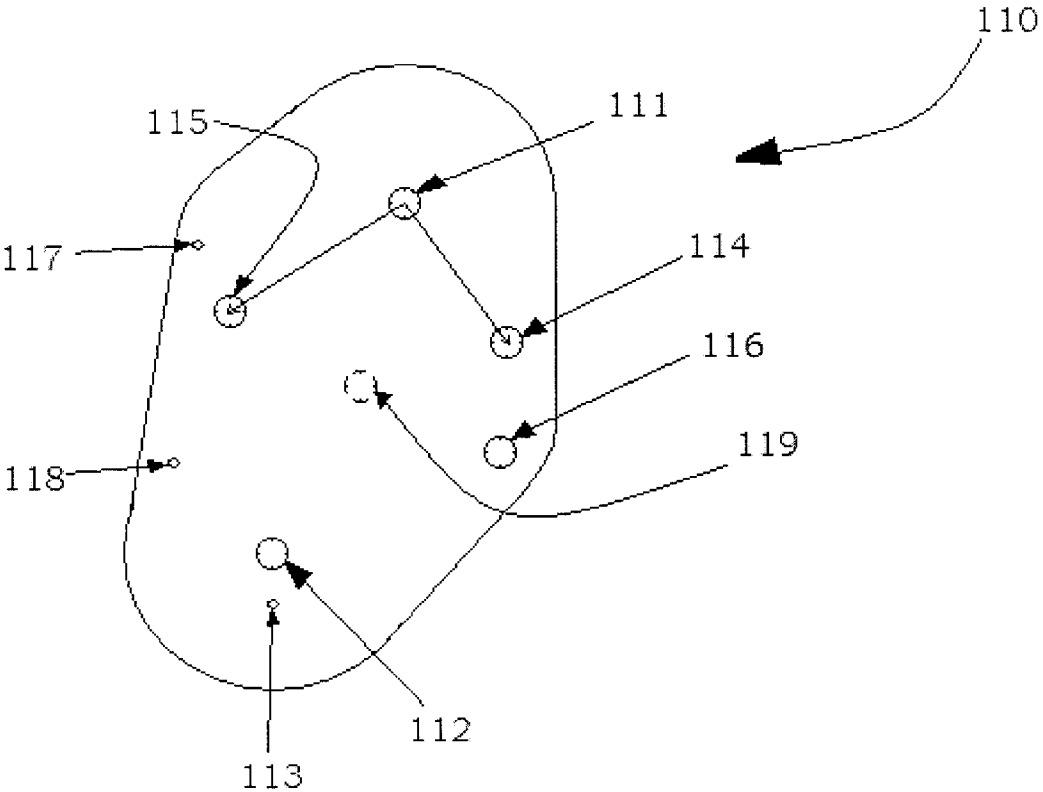
FIG. 4 is an elevation view of a first sheave mounting plate in accordance with example embodiments.

Referring to FIGS. 1 and 4, the first sheave mounting plate 110 may include a plurality of holes through which various pins and screws (or portions thereof) may pass. For example, in example embodiments, the first sheave mounting plate 110 may include a first hole 111 and a second hole 112 through which a body of a first tear drop pin 250 and a body of a second tear drop pin 260 may respectively pass. Thus, a diameter of the first hole 111 and the second hole 112 may be substantially the same as, or slightly larger than, a diameter of a body of the first tear drop pin 250 and a body of the second tear drop pin 260, respectively. For example, a diameter of the first hole 111 and the second hole 112 may be about 1 inch, however, the invention is not limited thereto.

In addition to the first and second holes 111 and 112, the first sheave mounting plate 110 may include third hole 113 arranged near the second hole 112. The third hole 113 may be a threaded hole configured to engage threads of a cap screw 267 as shown in FIG. 1. In example embodiments, the cap screw 267 may secure the second tear drop pin 260 to the first sheave mounting plate 110.

In example embodiments, the first sheave mounting plate 110 may further include fourth and fifth holes 114 and 115. In example embodiments, the fourth and fifth holes 114 may be configured to allow a hitch pin 220 to pass therethrough. Thus, the fourth and fifth holes 114 and 115 may have substantially the same diameter which may be substantially the same as, or slightly larger than, a diameter of the hitch pin 220. For example, the hitch pin 220 may have a diameter of about 1 inch and the fourth and fifth holes 114 and 115 may have a diameter of about 1 inch or larger. In addition, the centers of the fourth and fifth holes 114 and 115 should be about equidistant from the center of the first hole 111 since, when assembled the first sheave mounting plate 110 will rotate about an axis passing through the first hole 111 and the hitch pin 220 passing through one of the fourth hole 114 and fifth hole 115 acts to lock the horsehead 100 in a first, second, or intermediate position.

In example embodiments, the first sheave mounting plate 110 may further include a sixth hole 116 configured to allow a hitch pin 210 to pass therethrough. Thus, the sixth hole 116 may have a diameter which is substantially the same as, or slightly larger than, a diameter of the hitch pin 210. For example, the hitch pin 210 may have a diameter of about 1 inch and the sixth hole 116 may have a diameter of about 1 inch or larger.

In example embodiments, the first sheave mounting plate 110 may further include seventh and eighth holes 117 and 118. In example embodiments, the seventh and eighth holes 117 and 118 may be configured to allow first and second cap screws 150 and 160 to pass therethrough. Thus, the seventh and eighth holes 117 and 118 may have diameters which may be substantially the same as, or slightly larger than, the diameters of the first and second cap screws 150 and 160. For example, the first and second cap screws 150 and 160 may have a diameter of about ⅜ inch and the seventh and eighth holes 117 and 118 may have a diameter of about ⅜ inch or larger.

Figure 5:
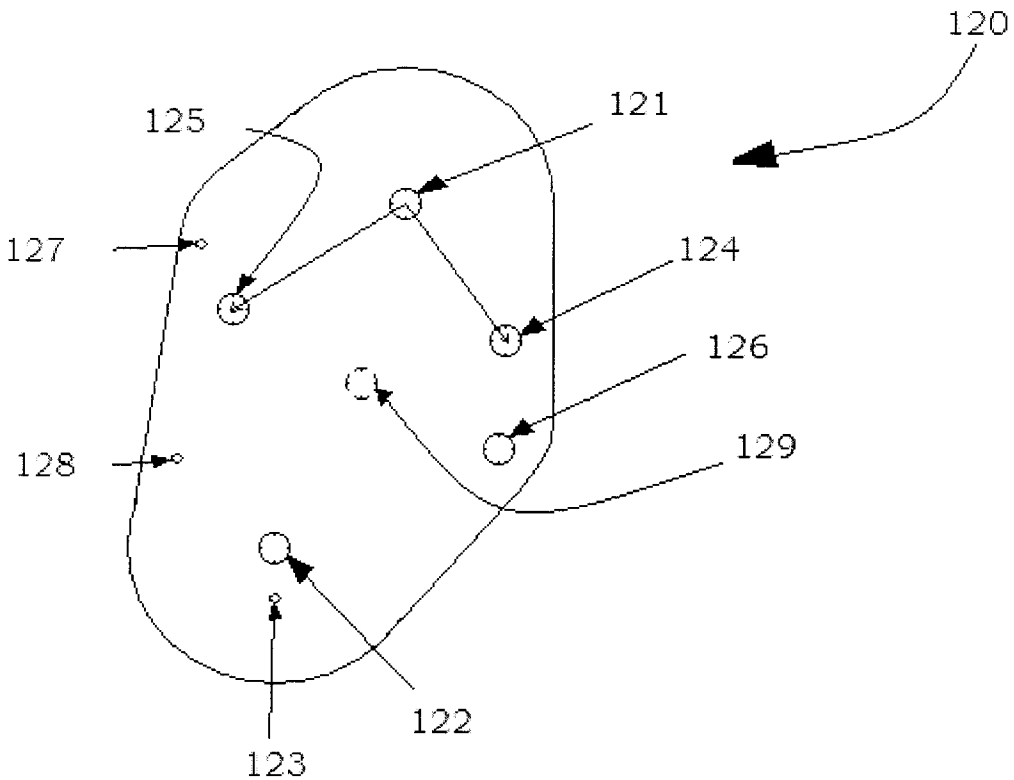
FIG. 5 is an elevation view of a second sheave mounting plate in accordance with example embodiments.

In example embodiments, the second sheave mounting plate 120, as shown in FIG. 5, may be substantially identical to the first sheave mounting plate 110. For example, as shown in FIG. 5, the second sheave mounting plate 120 may have a first hole 121, a second hole 122, a third hole 123, a fourth hole 124, a fifth hole 125, a sixth hole 126, a seventh hole 127, and an eighth hole 128 which have substantially the same arrangement and size as the first hole 111, the second hole 112, the third hole 113, the fourth hole 114, the fifth hole 115, the sixth hole 116, the seventh hole 117, and the eighth hole 118 of the first sheave mounting plate 110.

In example embodiments, the first sheave mounting plate 110 and the second sheave mounting plate 120 may be connected to each other via connecting structures, for example, the first and second cap screws 150 and 160. For example, referring to FIGS. 1, 4, and 5, the first cap screw 150 may be inserted through the seventh hole 127 (from a left side, outside face) of the second sheave mounting plate 120 and through the seventh hole 117 of the first sheave mounting plate 110 to engage a first nut 190 which may be arranged on a right side (outside face) of the first sheave mounting plate 110. Similarly, the second cap screw 160 may be inserted through the eighth hole 128 (from a left side, outside face) of the second mounting plate 120 and through the eighth hole 118 of the first sheave mounting plate 110 to engage a second nut 200 which may be arranged on a right side (outside face) of the first sheave mounting plate 110. Separation of the first and second sheave mounting plates 110 and 120 may be maintained by threading the first and second cap screws 150 and 160 through first and second spacers 170 and 180 which may be substantially tubular members having an outer diameter larger than the diameters of any one of the seventh and eighth holes 117, 118, 127, and 128 of the first and second sheave mounting plates 110 and 120. Although example embodiments illustrate the first and second sheave mounting plates 110 and 120 as being connected via cap screws and nuts, example embodiments are not limited thereto. For example, rather than using cap screws and nuts, pins may be used to connect the first and second sheaving mounting plates 110 and 120 to one another.

Figure 6:
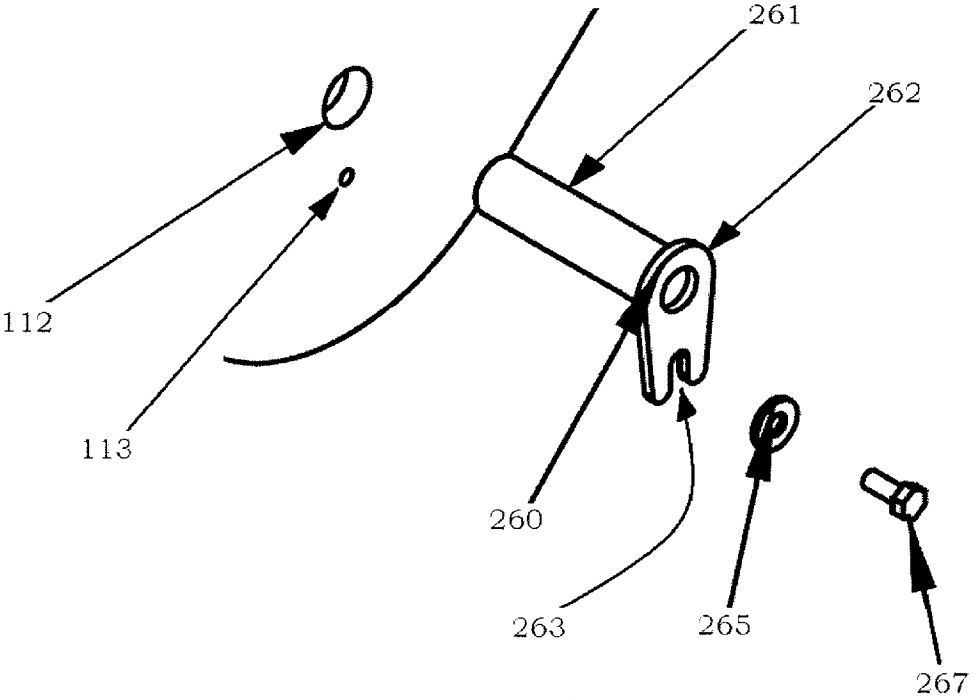
FIG. 6 is a close up view of a tear drop pin in accordance with example embodiments.

FIG. 6 is a close up view of the second tear drop pin 260. As shown in FIG. 6, the second tear drop pin 260 includes a cylindrical body 261 and a flange 262. The flange 262 may have a generally oval shape with a recess 263 formed at one end. In the alternative, the flange may include a hole at the one end rather than a recess. In this latter example, the hole should be large enough for a cylindrical body of a cap screw to pass through. During installation, the recess 263 (or hole) may be arranged to expose the third hole 113 of the first sheave mounting plate 110. Thus, during assembly, the cap screw 267 may be inserted into the recess 263 (or the hole) and into the third hole 113 to secure the second tear drop pin 260 to the first sheave mounting plate 110. In example embodiments, a washer 265 may be provided between a head of the cap screw 267 and the flange 262 of the second tear drop pin 260 in order to reduce stress on the second tear drop pin 260 and/or ensure the cap screw head of the cap screw 267 does not pass through the recess 263 or hole of the second tear drop pin 260.

In example embodiments, the body 261 of the second tear drop pin 260 passes through the second hole 112 of the first sheave mounting plate 110, the second sheave 140, and the second hole 122 of the second sheave mounting plate 120. Thus, the second tear drop pin 260 rotationally supports the second sheave 140. Because the body 261 of the second tear drop pin 260 passes through the first sheave mounting plate 110, the second sheave 140, and the second sheave mounting plate 120, a length of the body 261 must be at least as long as a sum of a width of the second sheave 140, a thickness of the first sheave mounting plate 110, and a thickness of the second sheave mounting plate 120.

As outlined above, the horsehead 100 may be partially assembled by attaching the first sheave mounting plate 110 to the second sheave mounting plate 120 via the first and second cap screws 150 and 160. Further, the second sheave 200 may be secured between the first and second sheave mounting plates 110 and 120 via the second tear drop pin 260. In example embodiments, the partially assembled horsehead 100 may be pivotally attached to the end bracket of the boom 300 via the first tear drop pin 250. For example, after attaching the first and second sheave mounting plates 110 and 120 together via the first and second cap screws 150 and 160, spacers 170 and 180, and the nuts 190 and 200, the first and second sheave mounting plates 110 and 120 may be moved between the first and second plates 310 and 320 of the boom 300 end bracket so that the first holes 326, 121, 111, and 316 of the second plate 320, the second sheave mounting plate 120, the first sheave mounting plate 110, and the first plate 310 are aligned. Then, the first sheave 130 may be positioned between the first and second sheave mounting plates 110 and 120 so that an axis of the first sheave 130 is substantially coincident with a line passing through the centers of the aligned first holes 326, 121, 111, and 316 of the second plate 320, the second sheave mounting plate 120, the first sheave mounting plate 110, and the first plate 310. In this configuration, a body of the first tear drop pin 250 may be threaded through the holes 316 and 111 of the first plate 310 and the first sheave mounting plate 120, through an axis of the first sheave 130, and through the holes 121 and 326 of the second sheave mounting plate 120 and the second plate 320. The first teardrop pin 250 may be secured to the first plate 310 of the boom mounting bracket via a cap screw 257 which may be inserted into a groove of a flange of the of the first tear drop 250 and into the third hole 318 of the first plate 310. In example embodiments, a washer 255 may be provided between a head of the cap screw 257 and a flange of the first tear drop pin 250 in order to reduce stress on the first tear drop pin 250.

Figure 7:
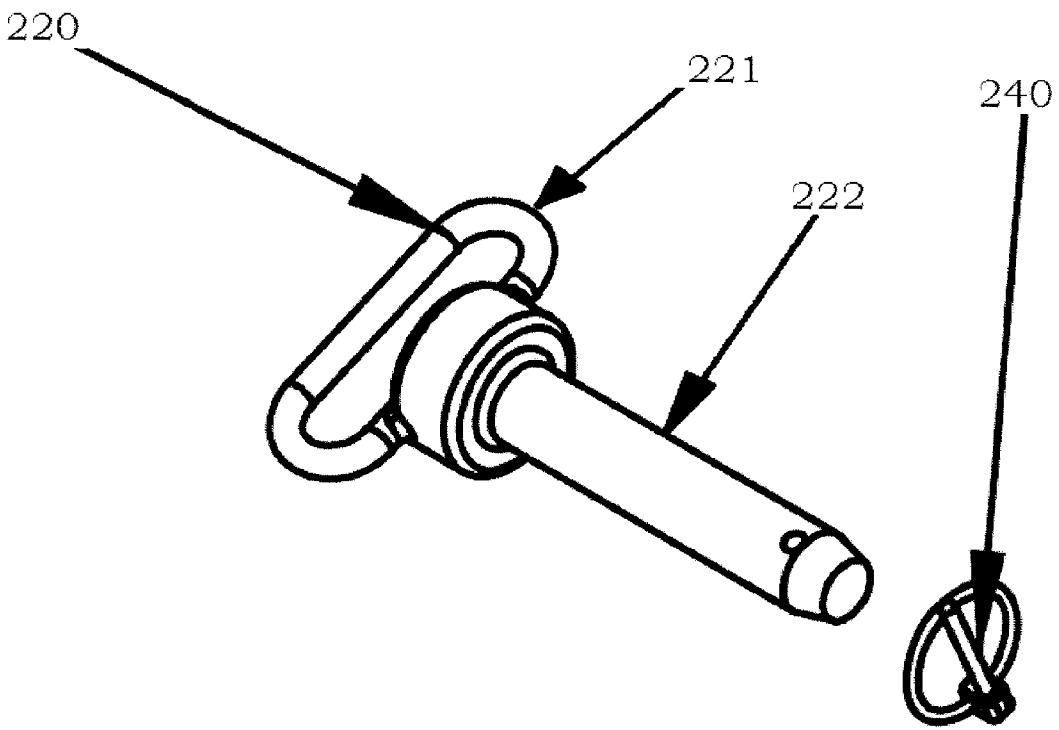
FIG. 7 is view of a hitch pin in accordance with example embodiments.
Figure 8:
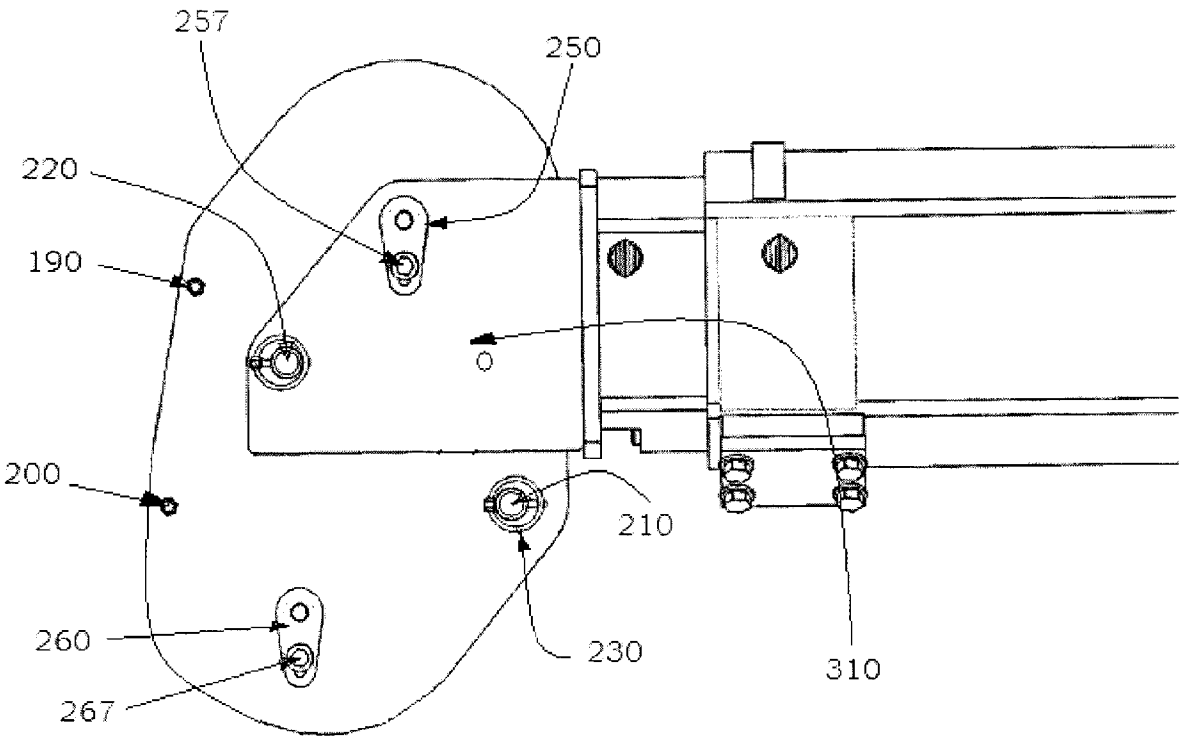
FIG. 8 is a side view the horsehead in a first position in accordance with example embodiments.

FIG. 7 is a close up view of the hitch pin 220. In example embodiments, the hitch pin 220 may include a handle 221 and a body 222 with a hole at a distal end. In example embodiments, the body 222 of the hitch pin 220 may be configured to connect to a lynch pin 240. In example embodiments, the horsehead 100 attached to the boom mounting bracket by the first tear drop pin 250 may be rotated so that the fifth hole 125 of the second sheave mounting plate 120, the second hole 327 of the second plate 320 of the boom end bracket, the second hole 317 of the first plate 310 of the boom end bracket, and the fifth hole 115 of the first sheave mounting plate 110 are aligned. In this position, the hitch pin 220 may be inserted into the fifth hole 125 of the second sheave mounting plate 120, from a left side thereof, through the boom end bracket via the seventh holes 327 and 317, and through the fifth hole 115 of the first sheave mounting plate 110 so that the hole of the hitch pin body 220 is exposed. The hitch pin 220 may be secured in place by the lynch pin 240. In this position (first position, see FIG. 8), the horsehead 110 is substantially perpendicular to the boom 300.

As outlined above, the body 222 of the hitch pin 220 passes through the second sheave mounting plate 120, the first and second plates 310 and 320 of the boom mounting bracket, and the first sheave mounting plate 110. Because the first and second sheave mounting plates 110 and the 120 are separated by a distance which is slightly larger than a thickness of the sheaves 130 and 140 sandwiched therebetween, a length of the body 222 of the hitch pin 220 must be at least as long as a sum of the thickness of the second sheave mounting plate 220, one of the thicknesses of the first and second sheaves 130 and 140, the thicknesses of the first and second plates 310 and 320 of the boom mounting bracket, and the thickness of the first sheave mounting plate 120.

In example embodiments, a hitch pin 210 may additionally be provided. For example, the hitch pin 210 may include a handle and a body similar to the handle 221 and the body 222 of the hitch pin 220. Furthermore, a body of the hitch pin 210 may have a hole configured to interact with a lynch pin 230. In example embodiments, the hitch pin 210 may pass through the sixth holes 116 and 126 of the first and second sheave mounting plates 110 and 210 and may be secured in place via the lynch pin 230.

Figure 9:
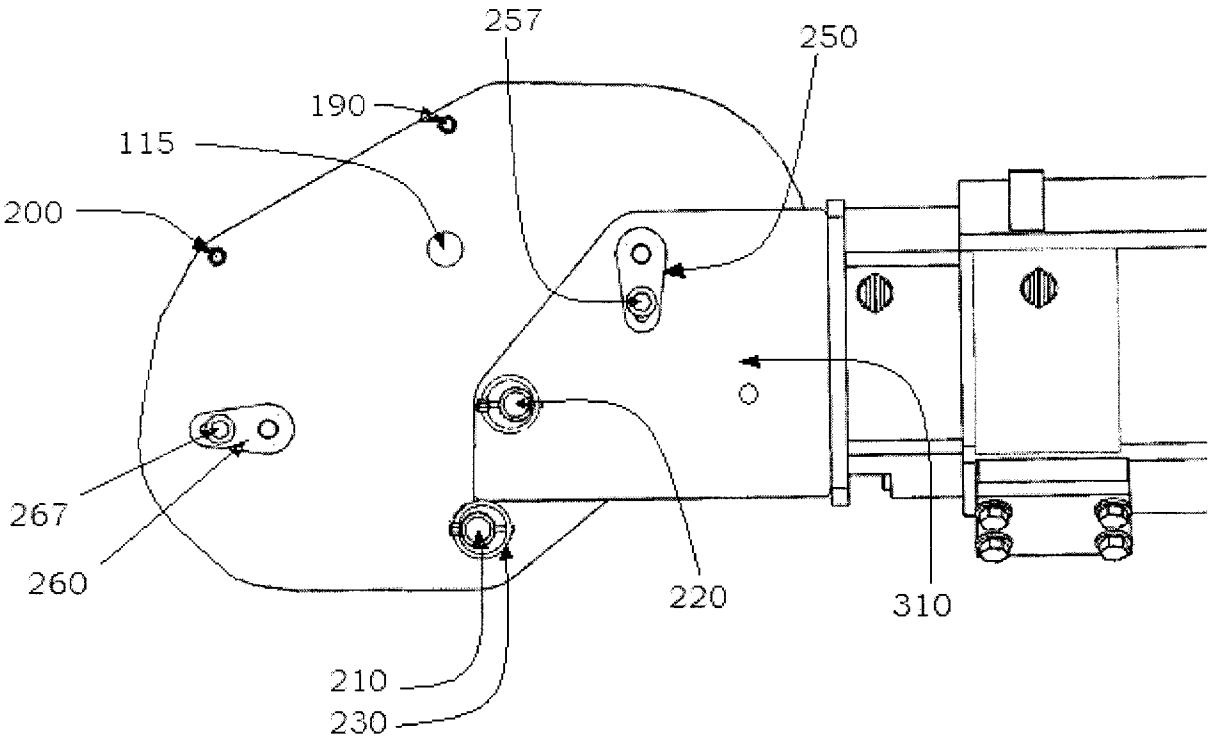
FIG. 9 is a side view the horsehead in a second position in accordance with example embodiments.

As described above, the horsehead 100 may be arranged substantially perpendicular to the boom 300 by aligning the fifth hole 125 of the second sheave mounting plate 120, the second hole 327 of the second plate 320 of the boom end bracket, the second hole 317 of the first plate 310 of the boom end bracket, and the fifth hole 115 of the first sheave mounting plate 110 and inserting the hitch pin 220 therein. However, example embodiments are not limited thereto. For example, rather than aligning the fifth hole 125 of the second sheave mounting plate 120, the second hole 327 of the second plate 320 of the boom end bracket, the second hole 317 of the first plate 310 of the boom end bracket, and the fifth hole 115 of the first sheave mounting plate 110, it is possible to alternatively align the fourth hole 124 of the second sheave mounting plate 120, the second hole 327 of the second plate 320 of the boom end bracket, the second hole 317 of the first plate 310 of the boom end bracket, and the fourth hole 114 of the first sheave mounting plate 110. In this configuration, the hitch pin 220 may be inserted into the aligned holes to lock the horsehead 100 in a second position (see FIG. 9) which is substantially in line with the boom 300.

Although example embodiments illustrate a horsehead 100 being arranged in one of two positions, the horsehead could be arranged in an intermediate position (or more positions). For example, the first and second sheave mounting plates 110 and 120 may each include an additional ninth hole 119 and 129 being equidistant from the first holes 111 and 121. Thus, rather than aligning the fifth hole 125 of the second sheave mounting plate 120, the second hole 327 of the second plate 320 of the boom end bracket, the second hole 317 of the first plate 310 of the boom end bracket, and the fifth hole 115 of the first sheave mounting plate 110 to align the horsehead 100 in the second position, it is possible to alternatively align the ninth hole 129 of the second sheave mounting plate 120, the second hole 327 of the second plate 320 of the boom end bracket, the second hole 317 of the first plate 310 of the boom end bracket, and the ninth hole 119 of the first sheave mounting plate 110. In this configuration, the hitch pin 220 may be inserted into the aligned holes to lock the horsehead 100 in a third position between the first and second positions.

In example embodiments, a cable (not shown) is threaded around the sheaves 130 and 140 of the horsehead 100 and to a hook (not shown) which includes its own set of pulleys/sheaves. In the conventional art, in order to prevent the two-block condition from occurring, touch bars, coupled to a sensor, are employed to detect an impending collision between the horsehead and the hook. The conventional touch bars, for example, are generally pin connected to the horsehead. However, in the conventional art, the conventional touch bars are also generally connected to the horsehead so that if the horsehead were to rotate, the touch bar would rotate as well. The inventors have realized that if a horsehead were to rotate, the conventional touch bar could be rotated into a position that is not usable to detect a two block condition. Thus, the inventors have realized that the conventional touch bars may not be suitable for horseheads that are rotatable. Accordingly, in example embodiments, a novel touch bar assembly is provided in order to maintain an orientation of the touch bar despite the horsehead 100 being rotated to either the first position or the second position.

Figure 10:
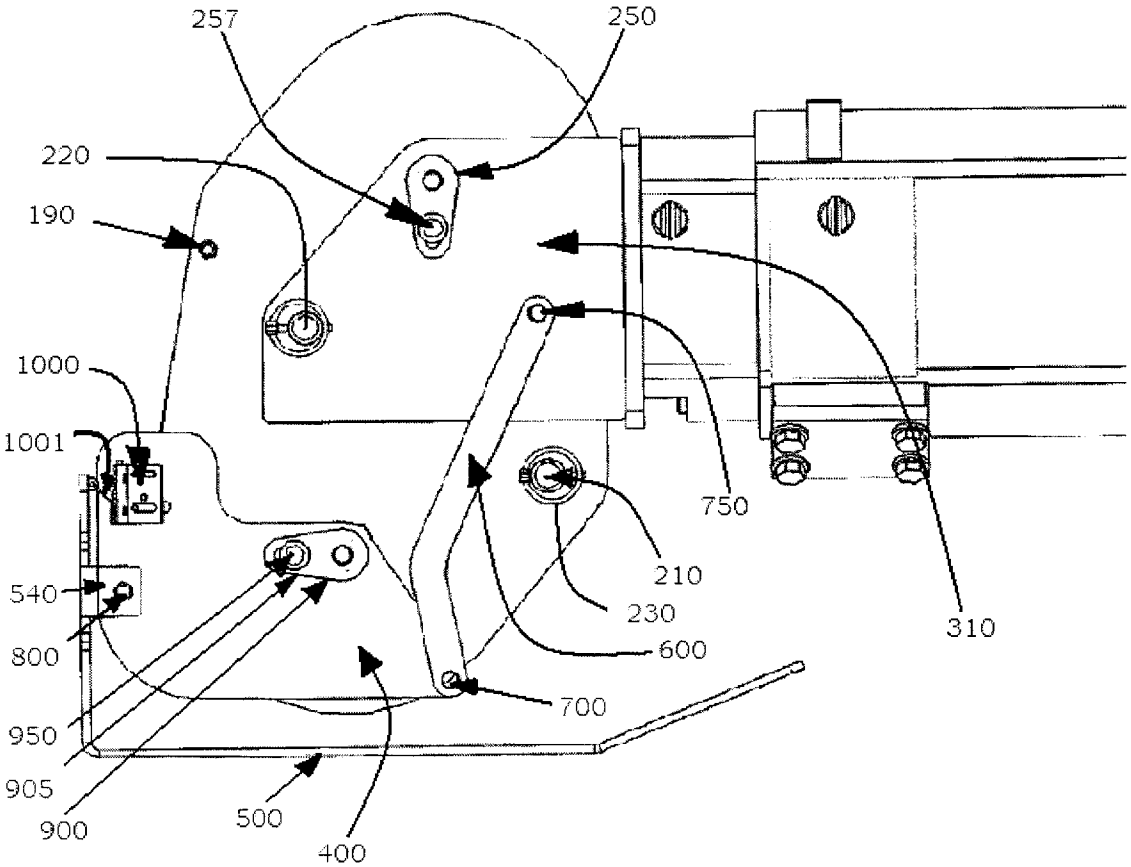
FIG. 10 is a side view of a two-block sensing system attached to the horsehead in the first position in accordance with example embodiments.
Figure 11:
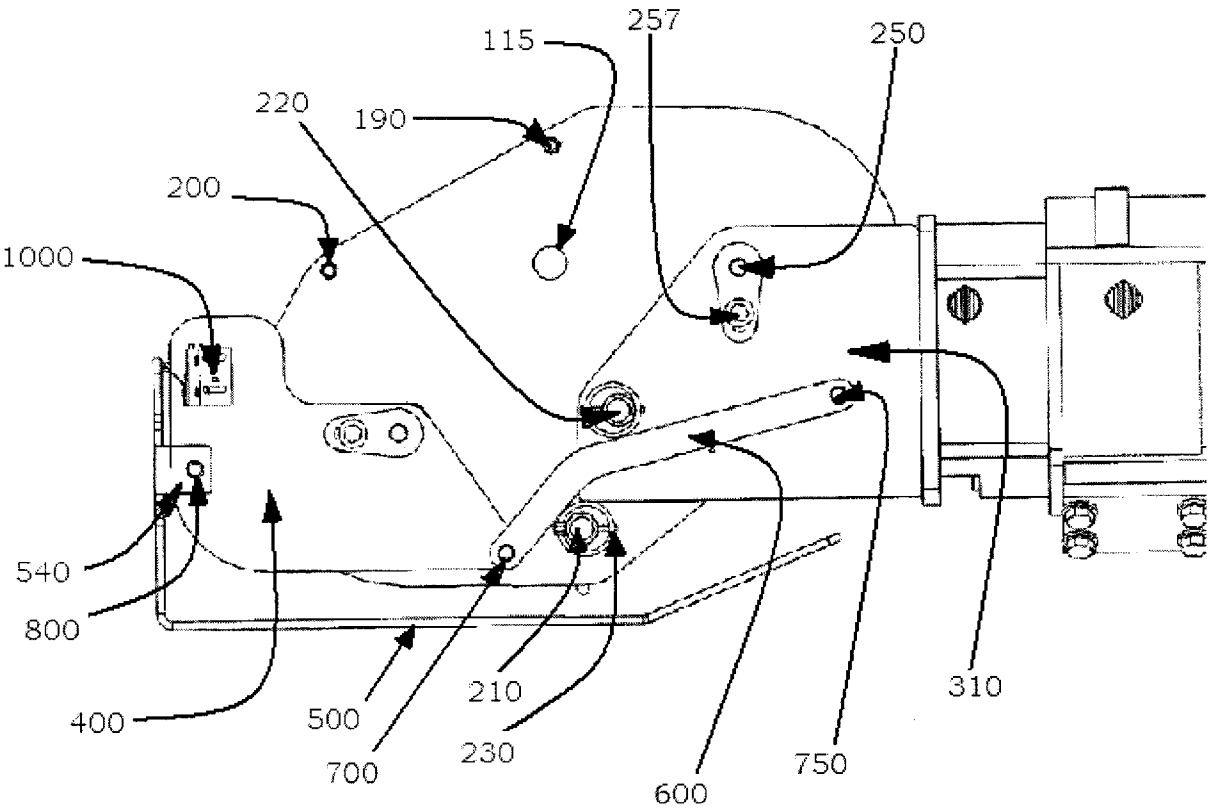
FIG. 11 is a side view the two-block sensing system attached to the horsehead in the second position in accordance with example embodiments.

In example embodiments, the horsehead 100 may be fitted with a two-block sensing system as shown in FIGS. 10 and 11. In example embodiments, the two-block sensing system (an example of a sensing device) may include a touch bar 500, an anti two-block (A2B) mount 400, a link 600, and a switch 1000. In example embodiments. The switch 1000 may be operably connected to a motor controlling the spooling of the cable or the crane upon which the horsehead 100 is mounted. Furthermore, the switch 1000 may either be active or passive, thus, in operation the motor controlling the spooling of the cable may be controlled by either activating or deactivating the switch 1000.

Figure 12:
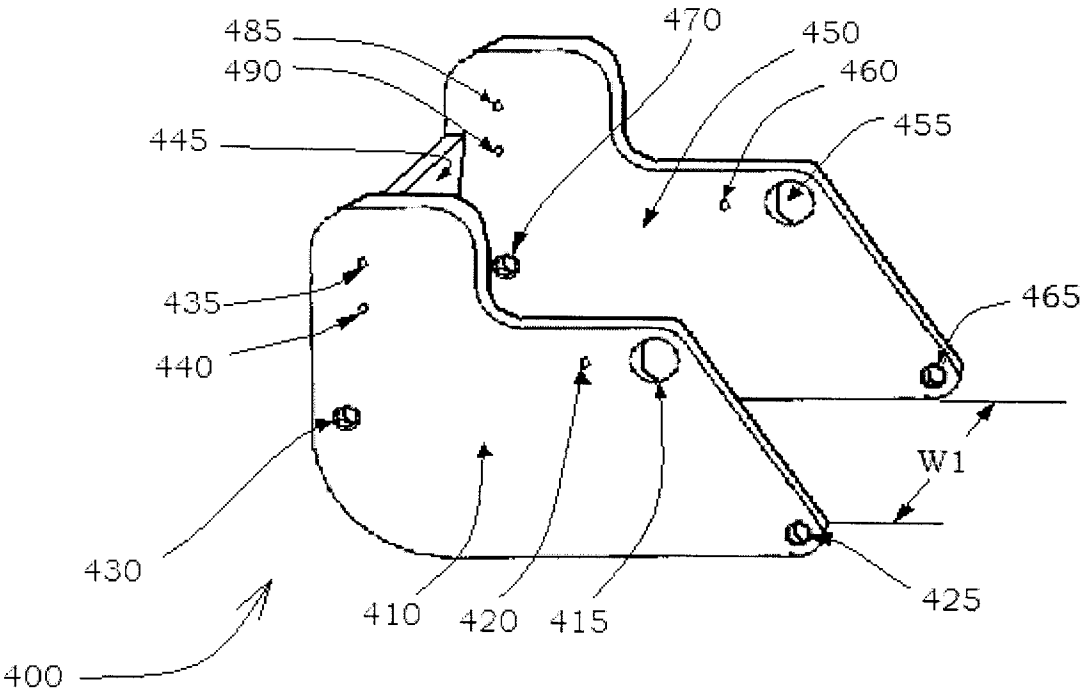
FIG. 12 is a perspective view of an A2B mount in accordance with example embodiments.

Referring to FIG. 12, the A2B mount 400 may be comprised of a first plate 410, a second plate 450, and a third plate 445. As shown in FIG. 12, the first plate 410 and the second plate 450 may be substantially identical and may be arranged to be parallel with one another. The third plate 445 may connect the first plate 410 to the second plate 450. Thus, the first plate 410, the second plate 450, and the third plate 445 may form an integral structure. Example embodiments, however, are not limited thereto. For example, in example embodiments the first plate 410 and the second plate 450 may be connected to one another via screws and spacers similar to those used to connect the first sheave mounting plate 110 to the second sheave mounting plate 120. As another example, rather than forming the A2B mount 400 from three separate plates, the A2B mount 400 may be formed from a cast, thus constituting a single member.

In example embodiments, the first and second plates 410 and 450 may be substantially "L-shaped," though example embodiments are not limited thereto. Furthermore, inside surfaces of the first and second plates 410 and 450 face outside surfaces of the first and second sheave mounting plates 110 and 120. Thus, a distance W1 separating inside surfaces of the first and second plates 410 and 450 is about equal to, or slightly larger than, a sum of the thickness of the first sheaving mounting plate 110, the second sheave mounting plate 120, and the second sheave 140. Because the first and second plates 410 and 450 may be substantially identical, only the first plate 410 will be described in detail.

As shown in FIG. 12, the first plate 410 of the A2B mount 400 may include a plurality of holes. For example, the first plate 410 may include a first hole 415, a second hole 420, a third hole 425, a fourth hole 430, a fifth hole 435, and a sixth hole 440. Similarly, the second plate 450 may include a first hole 455, a second hole 460, a third hole 465, a fourth hole 470, a fifth hole 485, and a sixth hole 490 which may be substantially similar to, in size and location, to the first hole 415, the second hole 420, the third hole 425, the fourth hole 430, the fifth hole 435, and the sixth hole 440 of the first plate 410.

In FIGS. 1-9, the horsehead 100 may include the second tear drop pin 260 passing through the first sheave mounting plate 100, the second sheave 140, and the second sheave mounting plate 120. However, in example embodiments of FIGS. 10-11, the second tear drop pin 260 passing only through the first sheave mounting plate 100, the second sheave 140, and the second sheave mounting plate 120 is replaced by a tear drop pin 900 which passes through the first plate 410 of the A2B mount 400, the first sheave mounting plate 110, the second sheave 140, the second sheave mounting plate 120, and the second plate 450 of the A2B mount 400. In example embodiments, the tear drop pin 900 may be substantially similar to the second tear drop pin 260 in that it includes a flange 905 and a body. The flange 905, as shown in FIGS. 10 and 11, may interface with an outside surface of the first plate 410 of the A2B mount. Furthermore, as shown in FIGS. 10 and 11, the flange 905 may be secured to the first plate 410 by a cap screw 950 which may be inserted into the second hole 420 of the first plate 410.

As alluded to above, the A2B mount 400 may be attached to the horsehead 100 via a tear drop pin 900 which passes through the first plate 410, the first sheave mounting plate 110, the second sheave 140, the second sheave mounting plate 120, and the second plate 450. Thus, a body of the tear drop pin 900 must be long enough to extend through the aforementioned assembly. In other words, the body of the tear drop pin 900 should have a length which is substantially equal to a sum of a thickness of the first plate 410, a thickness of the first sheave mounting plate 110, a thickness of the second sheave 140, a thickness of the second sheave mounting plate 120, and a thickness of the second plate 450. Furthermore, because a body of the tear drop pin 900 may have a uniform diameter, the diameters of the first hole 415 of the first plate 410, second hole of the first sheave mounting plate 110, the second hole 122 of the second sheave mounting plate 120, and the first hole 455 of the second plate 450 may be substantially the same and may be about, or slightly larger than, a diameter of the body of the tear drop pin 900.

In example embodiments, the A2B mount may also be connected to the end bracket of the boom 300 via a pair of links 600, noting that only one link 601 is shown in the figures for the ease of description. The pair of links 600 includes a first link 601 and a second link (not shown) which is substantially identical to the first link. Because each of the first link 601 and the second link may be identical, only a description of the first link 601 will be provided.

Figure 13:
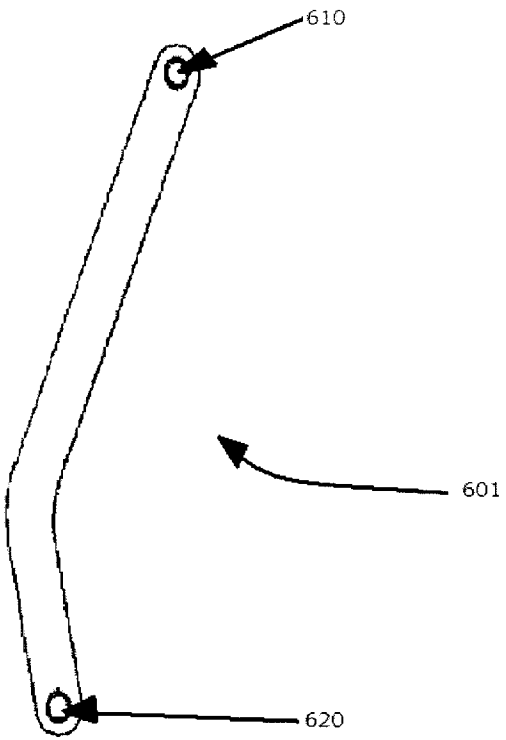
FIG. 13 is a view of a link in accordance with example embodiments.

In example embodiments the first link 601 may be a substantially bar shaped member having a first hole 610 arranged at a first end of the link and a second hole 620 arranged at a second end of the link. In example embodiments, the link 601 may have a bent shape as shown in FIGS. 10, 11, and 13. For example, the links 600 may be formed to include a bend having an angle of about 135 degrees, however, example embodiments are not limited thereto. As shown in FIGS. 10 and 11, the links 600 may be pin connected to the end bracket of the boom 300. For example, as shown 11, the first hole 610 of the link 601 may be in line with the fourth hole 319 of the first plate 310 of the end bracket. A pin 750 may be inserted through the first hole 610 of the link 601 and the fourth hole 319 of the first plate 310 to create a pin connection between the link 600 and the first plate 310. While not shown in the figures, a similar pin connection may be formed between the second link of the pair of links 600 and the second plate 320 of the end bracket, however, a pin, in addition to the pin 750, is used to connect the second link the second plate 320 of the end bracket.

In example embodiments, the pair of links 600 may also be pin connected to the A2B mount 400. For example, as shown in FIGS. 10 and 11, the second hole 620 of the link 601 is in line with the third hole 425 of the first plate 410 of the A2B mount 400. A pin 700 may then be inserted into the second hole 620 of the link 601 and the third hole 425 to pin connect the link 601 to the A2B mount 400. While not shown in the figures, a similar pin connection may be formed between the second link of the pair of links 600 and the A2B mount 400, however, a pin, different from the pin 700 is used to connect the second link the A2B mount 400.

Figure 14:
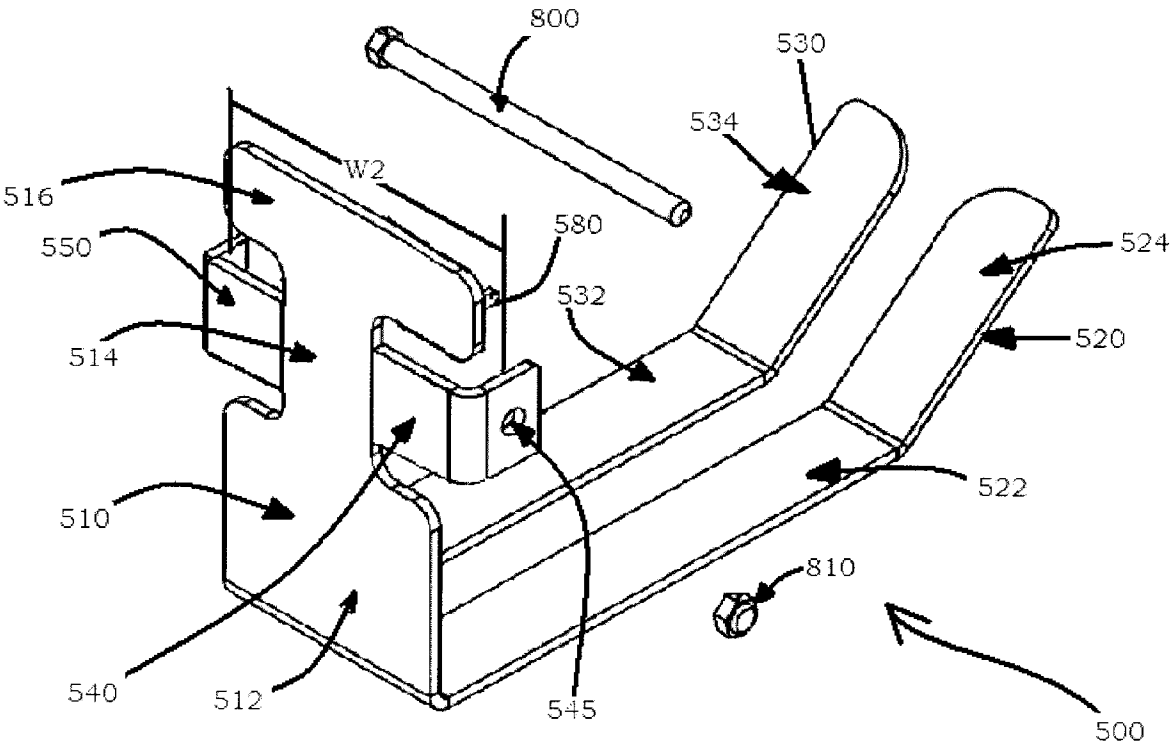
FIG. 14 is a view of a touch bar in accordance with example embodiments.

In example embodiments, a touch bar 500 may be connected to the A2B mount 400 via a pin connection. FIG. 14, for example, shows an example of a touch bar 500 in accordance with example embodiments. As shown in FIG. 14, the touch bar 500 may include a substantially vertical I-shaped back plate 510 having a first section 516, a second section 514, and a third section 512. In example embodiments, the second section 514 may have a width which is substantially smaller than widths of either the first section 516 or the third section 512, thus, the back plate 510 may have an I-shape. However, example embodiments are not limited thereto as widths of the first section 516, the second section 514, and the third section 512 may be substantially the same.

As shown in FIG. 14, the touch bar 500 may further include a pair of blades 520 and 530 projecting from a bottom of the back plate 510. The first blade 520 may include a substantially horizontal portion 522 and an inclined portion 524 forming an angle with the horizontal portion 522. The second blade 530 may likewise include a substantially horizontal portion 532 and an inclined portion 534 forming an angle with the horizontal portion 522. The cable (not shown) threaded through the first and second sheaves 130 and 140 may be threaded between the first and second blades 520 and 530. Although the blades 520 and 530 are illustrated as being comprised of substantially horizontal portions 522 and 532 and inclined portions 524 and 534, example embodiments are not limited thereto. For example, the blades may be curved.

In example embodiments, the touch bar 500 may also include a pair of tabs 540 and 550 extending from the second section 514. The tabs 540 and 550 may be substantially L-shaped members and each may include a hole passing therethrough. For example, the first tab 540 may include the hole 545 as shown in FIG. 14. The second tab 550 may likewise include a hole, which is not shown for the sake of simplicity. In example embodiments, inside surfaces of the tabs 540 and 550 may face outside surfaces of the first and second plates 410 and 450 of the A2B mount 400. Thus a distance W2 separating the inside surfaces of the first tab 540 and the second tab 550 should be about equal to, or slightly larger than a sum of the thickness of the first plate 410, the thickness of the first sheave mounting plate 110, the thickness of the second sheave 140, the thickness of the second sheave mounting plate 120, and the thickness of the second plate 450.

In example embodiments, the touch bar 500 may be pin connected to the A2B mount 400 via a pin 800 and a nut 810. For example, when the first touch bar 500 is connected to the A2B mount 400, the fourth hole 430 of the first plate 410 and the fourth hole 470 of the second plate are aligned with the hole 545 of the first tab 540 and the corresponding hole of the second tab 550. In this configuration, the pin 800 may be passed through the aforementioned holes and secured in place by the nut 810 which may be arranged on an outside surface of the first tab 540. In example embodiment, because the blade 500 may be connected to the A2B mount 400 by a pin 800, the blade 500 may be free to rotate with respect to the A2B mount.

In example embodiments, a switch 1000 (see FIG. 10) may be mounted on the A2B mount 400. For example, the switch 1000 may be attached to the A2B mount 400 via an adhesive. As another example, the switch 1000 may be attached to the A2B mount via fasteners, for example screws, that may be configured to engage threaded holes 435 and 440 of the first plate 410 or threaded holes 485 and 490 of the second plate 450. In example embodiments, the switch 1000 may be connected to the blade via a wire 1001 which may be connected to both the switch 1000 and a tab 580 of the blade 500. In example embodiments, the connection between the switch 1000 and the blade 500 is not limited to a wire connection. For example, rather than using a wire 1001, the connection could be made by a short link.

As explained above, a two block condition occurs when the hook's pulley block runs into the boom's pulley block (or sheaves). In example embodiments, a two-block sensing system, including the A2B mount 400 and the touch bar 500, is attached to the horsehead 100. Thus, if a hook's pulley were to approach a horsehead having the two-block sensing system, the hook's pulley block would engage the touch bar 500 attached to the A2B mount 400. Such contact would cause the blades 520 and 530 of the touch bar 500 to move towards the horsehead 100 thus rotating the touch bar 500 about the pin 800. Such a rotation would move the tab 580 away from the switch 1000 thus triggering the switch to turn the device driving the hook towards the horsehead 100 off. Accordingly, the two-block sensing system according to example embodiments may prevent a two-block condition from occurring.

In short, the A2B mount 400 may include a plurality of pin connections attaching the A2B mount 400 to the horsehead 100 and the end bracket of the boom 300. For example, the A2B mount 400 may be pin connected to the end bracket of the boom 300 via a pair of links 600. Furthermore, as explained above, the blade 500 may be pin connected or otherwise rotatably and/or movably connected to the A2B mount 400 and thus may rotate with respect to the A2B mount 400. Due to the arrangement and nature of the connections, the A2B mount remains relatively horizontal whether or not the horsehead 100 is arranged in the first position (as shown in FIG. 10) or the second position (as shown in FIG. 11). Thus, example embodiments provide for an A2B mount which includes a relatively stable position regardless of the orientation of the horsehead 100.

Figure 15A:
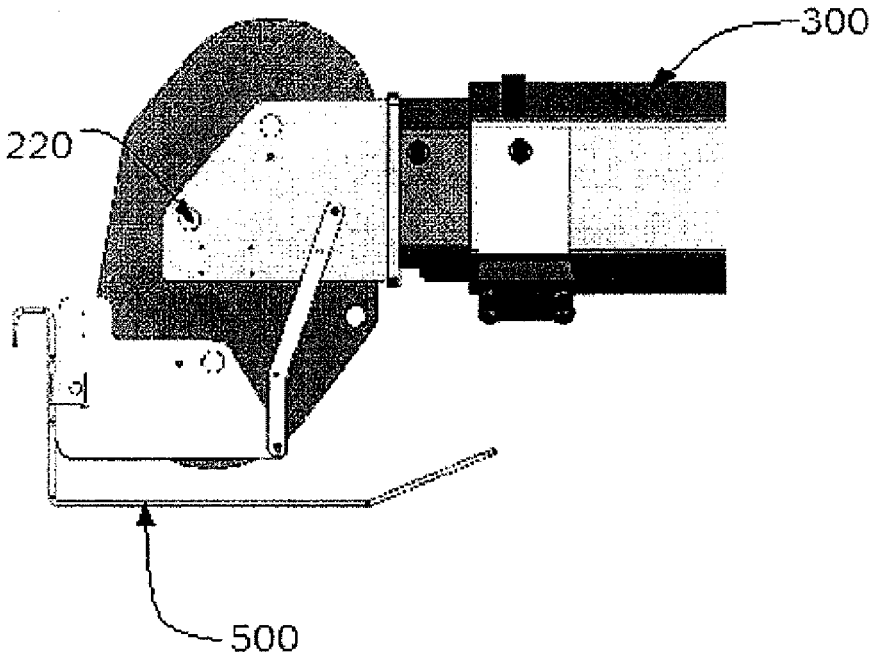
FIGS. 15A-15E illustrate various side views of a horsehead having the two-block sensing system attached thereto as the horsehead moves from a first position to a second position.

FIGS. 15A-15E illustrate the kinematics of the horsehead/two-block sensing system as the horsehead is rotated from the first position to the second position. In FIG. 15A, for example, the horsehead 100 is illustrated as being in a first position wherein the horsehead is substantially perpendicular to a boom of the crane. From FIG. 15A, it is obvious that the touch bar 500 is in a horizontal position. In the first position, the second hole 317 of the first plate 310 of the end bracket of the boom 300, the fifth hole 115 of the first sheave mounting plate 110, the fifth hole 125 of the second sheave mounting plate 120, and the second hole 327 of the second plate 320 of the end bracket of the boom 300 are aligned and the hitch pin 220 is inserted therein. In order to rotate the horsehead 100 to the second position, the hitch pin 220 is removed and the horsehead 100 is rotated clockwise.

Figure 15B:
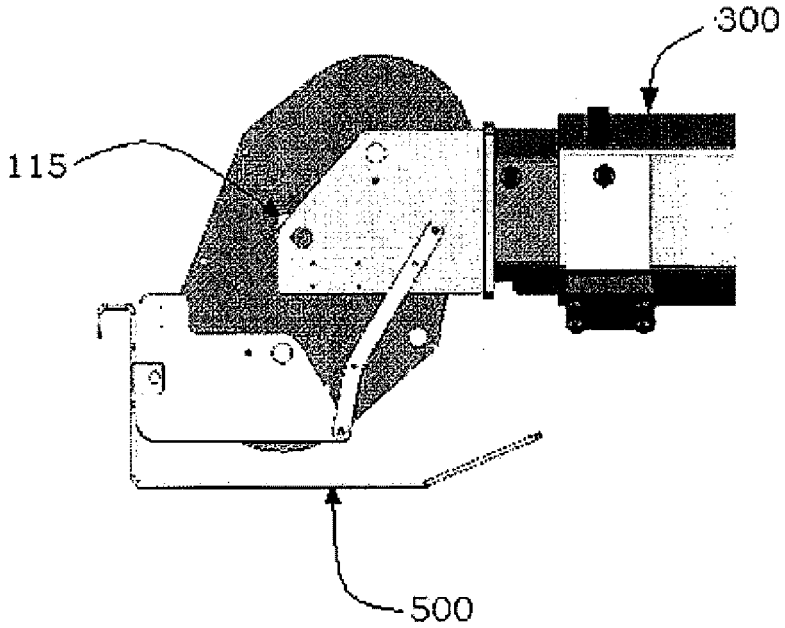
Figure 15C:
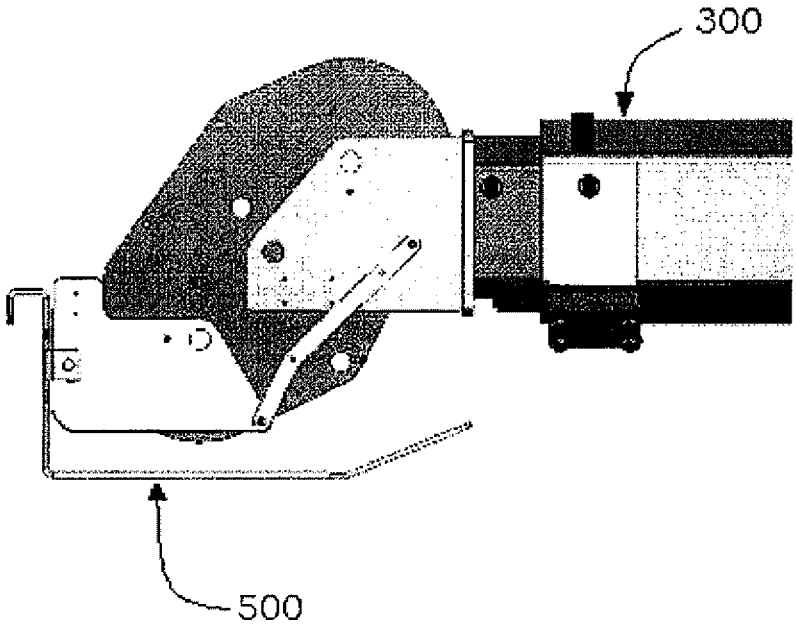
Figure 15D:
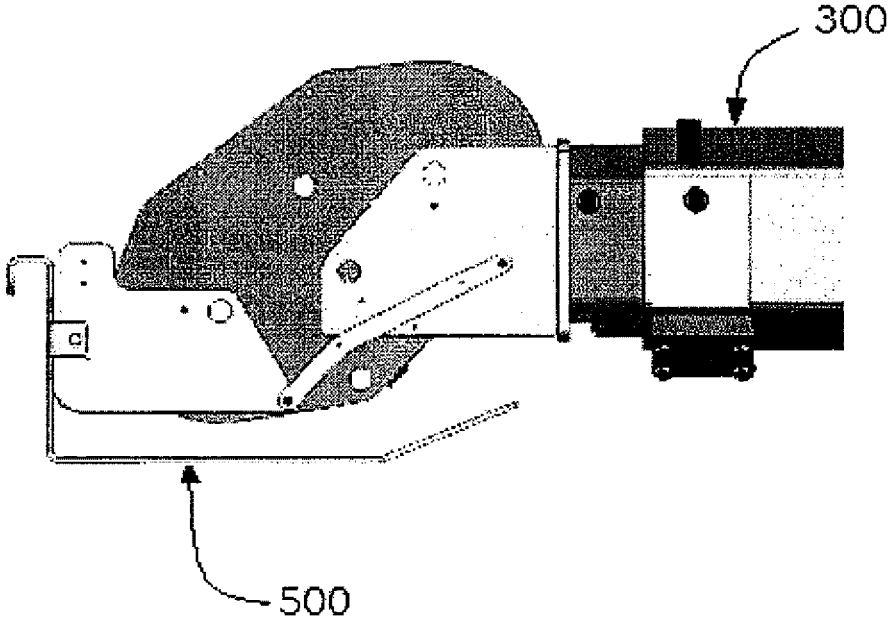

FIGS. 15B-15D show the configuration of the horsehead 100 as the horsehead 100 is rotated clockwise from the first position to the second position. As shown in FIGS. 15B-15D, the fifth holes 115 and 125 of the first and second sheave mounting plates 110 and 120 are rotated past the fifth surfaces 315 and 325 of the first and second plates 310 and 320 and the horsehead becomes inclined. However, because of the nature of the pin connections between the A2B mount 400 and the first and second sheave mounting plates 110 and 120 and the links 600 connecting A2B mount 400 to the first and second plates 310 and 320, the touch bar 500 remains substantially horizontal throughout the clockwise rotation of the horsehead 100.

Figure 15E:
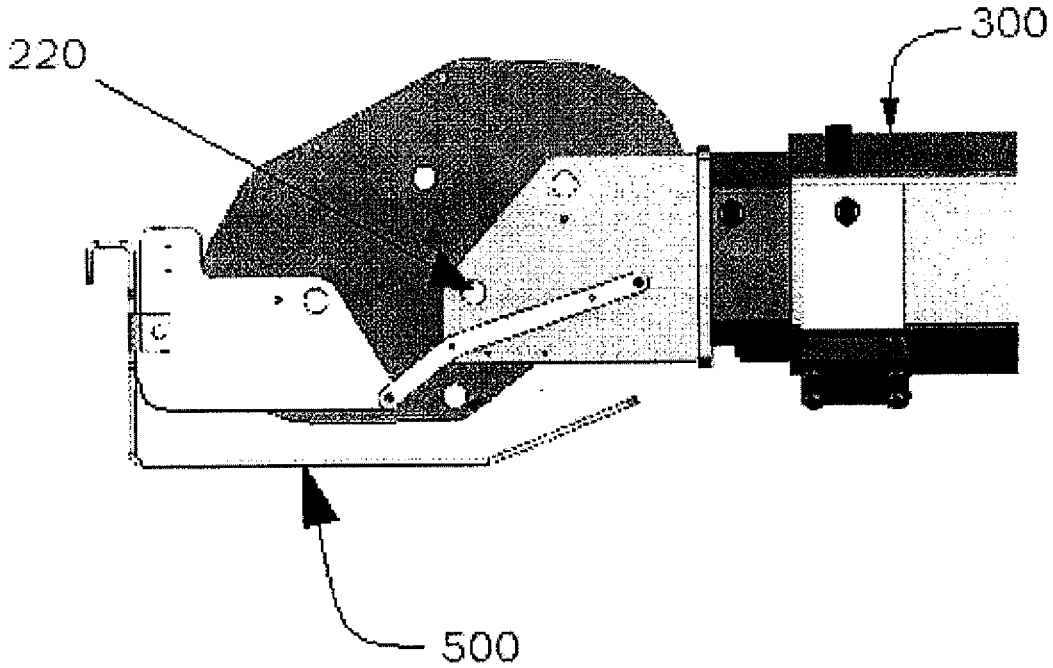

FIG. 15E shows the horsehead 100 in the second position wherein the horsehead 100 is substantially parallel to the boom 300 of the crane. From FIG. 15E, it is obvious that the touch bar 500 is still in a horizontal position. In the second position, the second hole 317 of the first plate 310 of the end bracket of the boom 300, the fourth hole 114 of the first sheave mounting plate 110, the fourth hole 124 of the second sheave mounting plate 120, and the second hole 327 of the second plate 320 of the end bracket of the boom 300 are aligned and the hitch pin 220 is inserted therein to lock the horsehead 100 into the second position.

As shown in FIGS. 15A-15E as the horsehead 100 moves from the first position to the second position, the touch bar translates from a third position to a fourth position with substantially little to no rotation, for example, will translate without rotating more than about 30 degrees.

Figure 16:
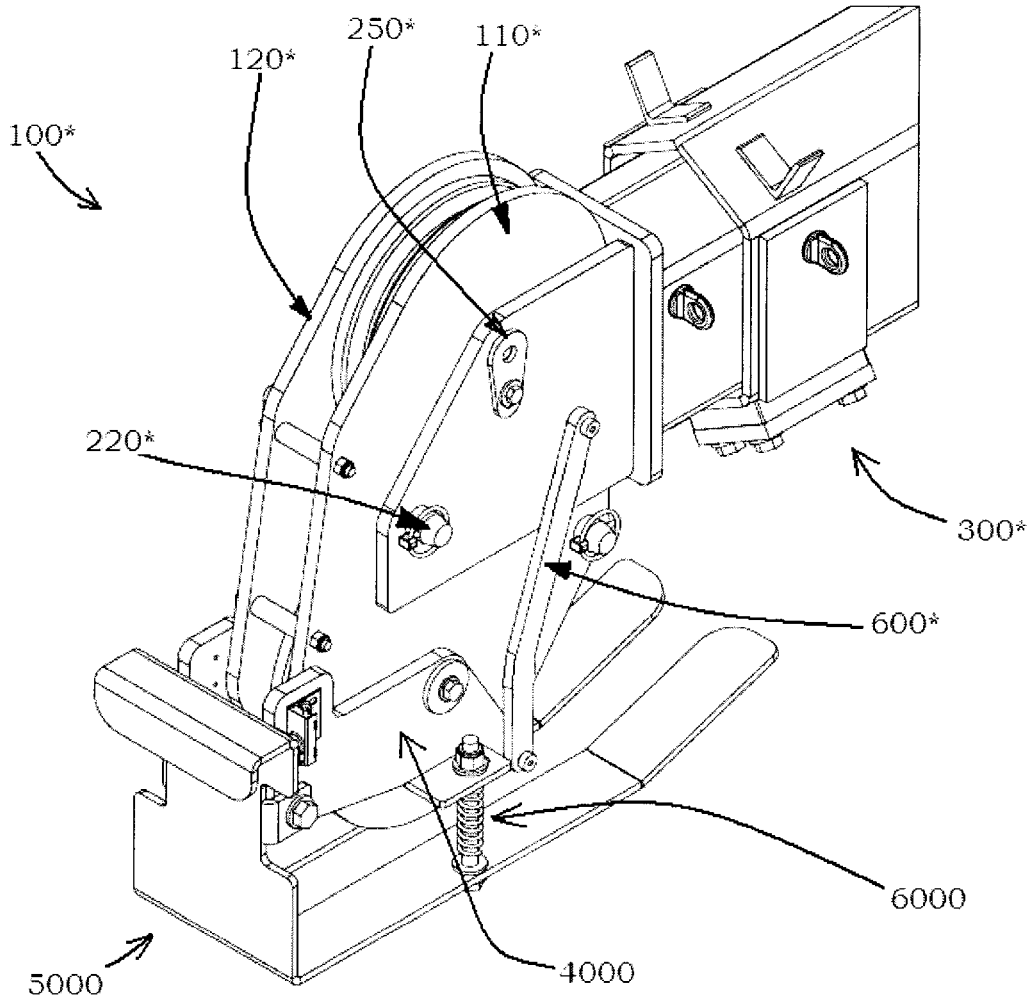
FIG. 16 is a perspective view of a horsehead in accordance with example embodiments.
Figure 17:
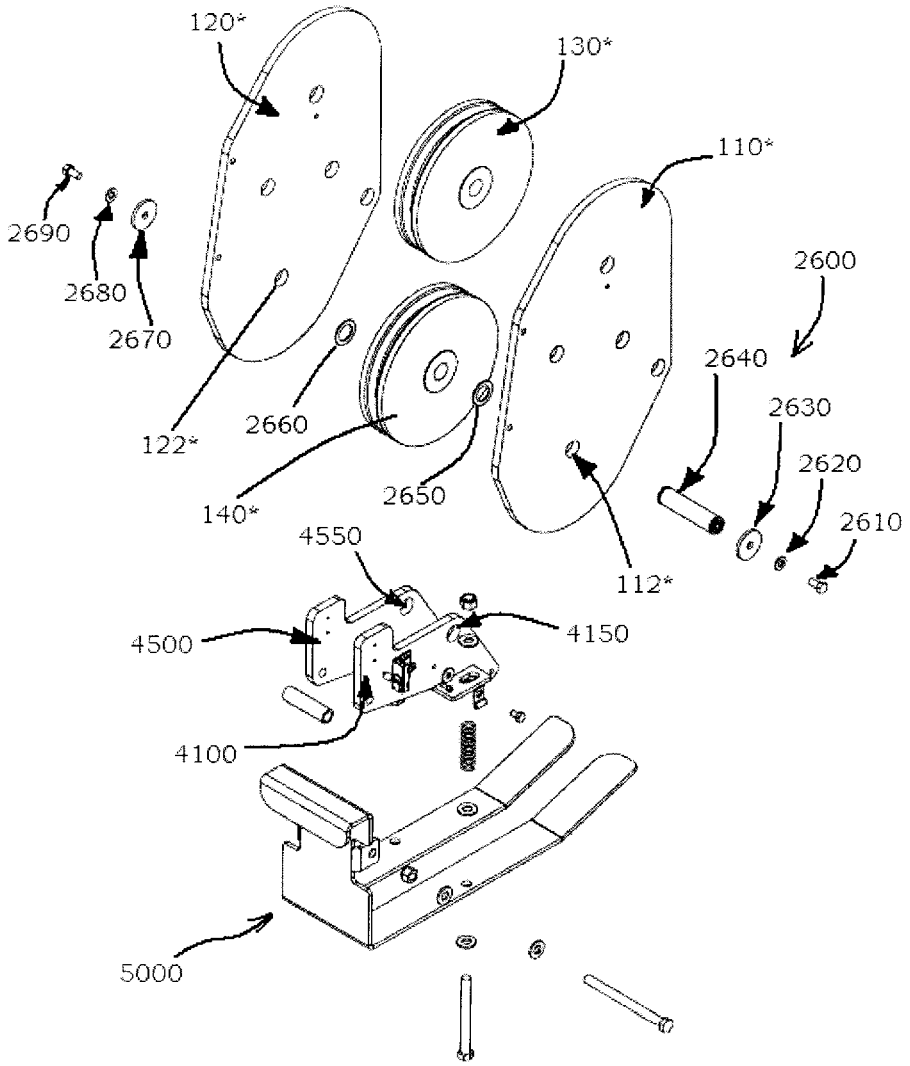
FIG. 17 is a partial exploded view of a horsehead in accordance with example embodiments.

FIG. 16 is a view of a horsehead 100* in accordance with example embodiments (a partially exploded view of which is shown in FIG. 17). The horsehead 100* illustrated in FIG. 16 may be similar to the horsehead 100 illustrated in FIG. 1. For example, the horsehead 100*, may include a first sheave mounting plate 110* and a second sheave mounting plate 120* sandwiching a first sheave 130* and a second sheave 140* (see FIG. 17) which may be substantially similar to the first and second sheave mounting plates 110 and 120 and the first an second sheaves 130 and 140 of the horsehead 100. Furthermore, the first and second sheaving mounting plates 110* and 120* may be connected to an end bracket of a boom 300* via a tear drop pin 250* and a hitch pin 220* which may be similar to the tear drop pin 250 and the hitch pin 220 of the horsehead 100. Further yet, the horsehead 100* includes a touch bar 5000 and an A2B mount 4000 which may be similar to the touch bar 500 and the A2B mount 400 discussed previously. For example, the touch bar 5000 may include a substantially vertical I-shaped back plate 5100 having a first section, a second section 5140, and a third section, wherein the second section 5140 may have a width smaller than that of the first and third sections. As another example, the A2B mount 4000 may include a first a first plate 4100 similar to the first plate 410 and a second plate 4500 similar to the second plate 450. For example, the first plate 4100 may include a hole 4250 and another hole 4300 similar to the third and fourth hole 425 and 430 of the first plate 410 and the second plate 4500 may include a hole 4700 similar to the fourth hole 470 of the second plate 450.

In example embodiments, the A2B mount 4000 may be connected to the end bracket of the boom 300* via a pair of links 600*(only one of which is shown in FIG. 16) which may each be like the previously described link 600. However, unlike the previously described nonlimiting horsehead 100, the horsehead 100* is further equipped with a biasing device 6000 configured to stabilize the touch bar 5000 relative to the A2B mount 4000. Another difference between the horsehead 100* involves the use of a pin assembly 2600 to connect the A2B mount 4000 to the horsehead 100*(and support the second sheave 140*).

Referring to FIG. 17, the pin assembly 2600 may include a cap screw 2610, a first washer 2620, a second washer 2630, a sleeve 2640, a first spacer 2650, a second spacer 2660, a third washer 2670, a fourth washer 2680, and a second cap screw 2690. In example embodiments the first and fourth washers 2620 and 2680 may, for example, be lock washers. In example embodiments, the first sheave mounting plate 110* may include a hole 112* which corresponds to the second hole 112 of the first sheave mounting plate 110 and the second sheave mounting plate 120* may include a hole 122* which corresponds to the second hole 122 of the second sheave mounting plate 120 of the horsehead 100. As will be discussed shortly, the pin assembly 2600 may be used to attach the A2B mount 4000 to the horsehead 100* and may also serve to support the second sheave 140*.

In example embodiments, the A2B mount 4000 includes two plates 4100 and 4500 which may be arranged on outside surfaces of the first and second sheave mounting plates 110* and 120*. The plates 4100 and 4500 may be substantially identical and may be substantially "L" shaped, however, this aspect of example embodiments is not meant to limit the present invention. In example embodiments the first plate 4100 of the A2B mount 4000 may include a first hole 4150 which may correspond to the first hole 415 of the first plate 410 of the A2B mount 400. Likewise, the second plate 4500 may include a first hole 4550 which may correspond to the first hole 455 of the second plate 450 of the A2B mount 450. A detailed description of the first and second plates 4100 and 4500 is omitted due to their similarities of the first and second plates 410 and 450 of the A2B mount 400.

The sleeve 2640 of the pin assembly 2600 may be fed through the first hole 4150 of the A2B mount 4000, the hole 112* of the first sheave mounting plate 110*, an axis of the second sheave 140*, the hole 122* of the second sheave mounting plate 120*, and the first hole 4550 of the second plate 4500 of the A2B mount 4000. In example embodiments, the ends of the sleeve 2640 may be tapped and thus may include internal threads configured to engage external threads of the first and second cap screws 2610 and 2690.

In order to reduce contact between the second sheave 140* and inside surfaces of the first and second sheave mounting plates 110* and 120*, spacers 2650 and 2660 may be provided between the inside surfaces of the first and second sheave mounting plates 110* and 120* and the second sheave 140*. The spacers 2650 and 2660 may, for example, resemble washers, however, example embodiments are not limited thereto as the spacers 2650 and 2660 may be roller bearings or low friction members. As shown in FIG. 17, the sleeve 2640 may pass through each of the spacers 2650 and 2660 in order to support spacers 2650 and 2660. In example embodiments the support spacers 2650 and 2660 are illustrated as annular members, however, example embodiments are not limited thereto as the spacers 2650 and 2660 may have a different shape, for example, a C-shape.

When assembled, ends of the sleeve 2640 are arranged near outside surfaces of the first and second plates 4100 and 4500. For example, a first end of the sleeve 2640 may be arranged in the hole 4150 of the first plate 4100 and a second end of the sleeve 2640 may be arranged in the hole 4550 of the second plate 4500. The second washer 2630 may be arranged over the first hole 4150 of the first plate 4100 to expose the first end of the sleeve 2640. The first screw 2610 may extend through the washer 2630 and into the first end of the sleeve 2640. In example embodiments an outer diameter of the second washer 2630 is larger the diameter of the hole 4150. Thus, when the first cap screw 2610 is connected the first end of the sleeve 2640 (for example, by engaging outer threads of the first cap screw 2610 with inner threads of the first end of the sleeve 2640), the washer 2630 prevents the sleeve 2640 (coupled to the cap screw 2610) from moving in a direction towards a middle of the horsehead 100*. Likewise, the third washer 2670 may be arranged on an outside surface of the second plate 4500 and over the hole 4550 to expose the second end of the sleeve 2640. The second screw 2610 may extend through the washer 2670 and into the second end of the sleeve 2640. In example embodiments an outer diameter of the third washer 2670 is larger than the diameter of the hole 4550. Thus, when the second cap screw 2610 is connected the second end of the sleeve 2640 (for example, by engaging outer threads of the second cap screw 2690 with inner threads of the second end of the sleeve 2640), the washer 2670 prevents the sleeve 2640 (coupled to the cap screw 2690) from moving in a direction towards a middle of the horsehead 100*.

Figure 18:
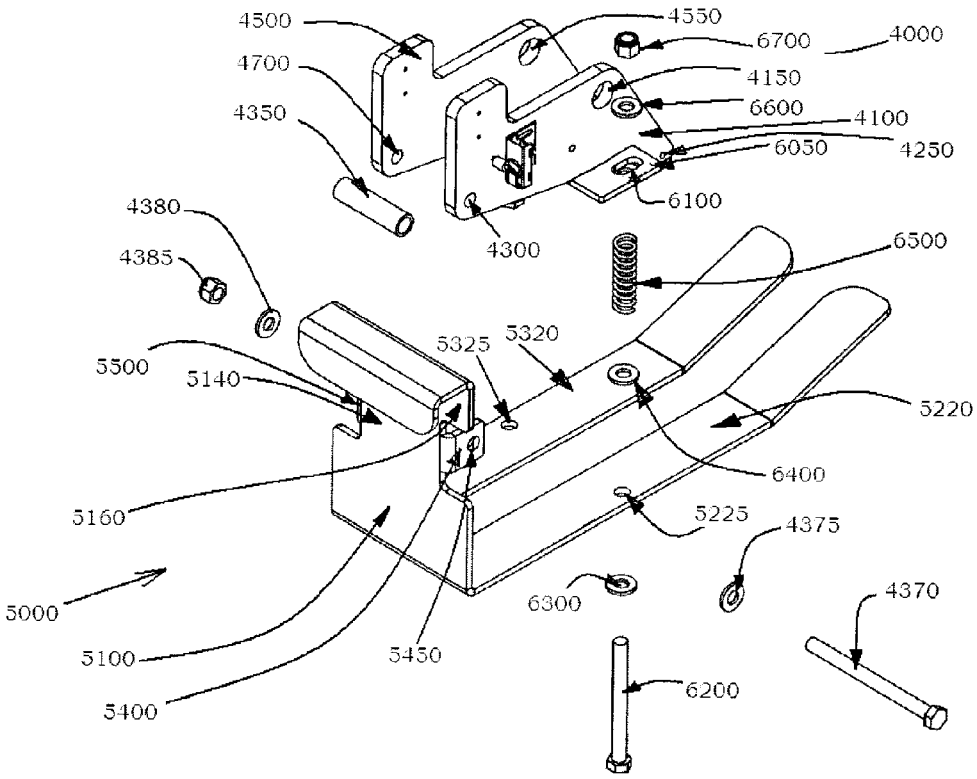
FIG. 18 is an exploded view of a touch bar, an A2B mount, and a biasing device.

FIG. 18 illustrates the A2B mount 4000 and touch bar 5000 in accordance with example embodiments. In example embodiments the A2B mount 4000 may be substantially identical to the A2B mount 400 (as illustrated in FIG. 12) and the touch bar 5000 may be substantially identical to the touch bar 500 (as illustrated in FIG. 14). Thus, only the differences will be discussed in detail.

In FIG. 12 the A2B mount 400 is illustrated as being comprised of two substantially parallel plates 410 and 450 which are connected by a third plate 445. However, in the FIG. 18, the A2B mount 4000 does not include a third plate. Although a third plate connecting the first plate 4100 to the second plate 4500 is not included in the A2B mount 4000, the inventive concepts do not preclude a third plate from being incorporated into the A2B mount 4000.

In the horsehead 100, the A2B mount 400 and the touch bar 500 are connected to one another via a pin 800 as shown in FIG. 14. Likewise, the A2B mount 4000 and the touch bar 5000 of the horsehead 100* are connected via a pin connection. For example, as shown in FIG. 18, a screw 4370 may be threaded through a hole 5450 of a first tab 5160 of the touch bar 5000, through a spacer 4350 provided between the first tab 5400 of the touch bar 5000 and a second tab 5500 of the touch bar 5000, and through a hole (not shown) in the second tab 5500 to mate with a nut 4385 arranged outside of the second tab 5500. The spacer 4350 may resemble a cylinder having an inside diameter substantially the same as, or larger than, an outer diameter of a body of the screw 4370 and may have a length sufficient to provide adequate spacing between the first and second plates 4100 and 4500 of the A2B mount 4000. Washers 4375 and 4380 may be incorporated into this connection to ensure stress is properly distributed between a head of the screw 4370 and the first tab 5400 and between the nut 4385 and the second tab 5500 as the nut is tightened against threads of the screw 4370. For example, the washer 4375 may be arranged between the head of the screw 4375 and an outside surface of the first tab 5400 and the washer 4380 may be arranged between an outside surface of the second tab 5500 and the nut 4385.

In example embodiments, the horsehead 100 includes links 600 to connect the A2B mount 400 to the end bracket of the boom 300. Similarly the horsehead 100* includes links 600* which connect the A2B mount 4000 to an end bracket of the boom 300*. Because the links 600* may be substantially identical to the links 600, and because the manner in which the links 600* are connected to the end bracket of the boom 300* and the A2B mount 4000 may be identical to the manner in which the links 600 are connected to the end bracket of the boom 300 and the A2B mount 400, a detailed description thereof is omitted for the sake of brevity.

As previously mentioned, the horsehead 100* of example embodiments includes a biasing device 6000 to stabilize the touch bar 5000 with respect to the A2B mount 4000. Referring to FIG. 18, the biasing device 6000 may be comprised of a screw 6200, a washer 6300, a biasing member 6500 (for example, a spring), a plate 6050, a washer 6600, and a nut 6700. In example embodiments, the plate 6050 may be a substantially rectangular plate with a hole 6100 passing therethrough. The plate 6050 may, for example, may be connected to the first plate 4100 of the A2B mount 4000. For example, the plate 6050 may be welded, adhered, or clamped to the first plate 4100. In the alternative, the plate 6050 may be formed integrally with the first plate 4100 in the event the first plate 4100 is fabricated in cutting or casting process. The hole 6100 may be circular, elliptical, rectangular, or slotted, however, example embodiments are not limited to holes having only these shapes.

In example embodiments, the screw 6200 may, for example, pass through a hole 5225 formed in a first blade 5220 of the touch bar 5000 and through the hole 6100 of the plate 6050 to engage the nut 6700. In example embodiments, the washer 6600 may be provided between the nut 6700 and the plate 6050 to ensure the nut does not pass through the hole 6100 and to reduce stress. Similarly, the washer 6300 may be provided between a head of the screw 6200 and the first blade 5220 of the touch bar 5000 to ensure the head of the screw 6200 does not pass through the hole 5225 and to reduce stress. In example embodiments, the second blade 5320 may include a hole 5325 that corresponds to the hole 5225 of the first blade 5220.

The biasing member 6500 may be provided between the first blade 5220 of the touch bar 5000 and the plate 6050. The biasing member 6500 may be a helical spring which is penetrated by the screw 6200. When installed, the biasing member 6500 may be slightly compressed in order to stabilize the touch bar 5000 with respect to the A2B mount 4000.

Although the biasing device 6000 has been described as comprising the screw 6200, the washer 6300, the washer 6400, the biasing member 6500 (for example, the spring), the plate 6050, the washer 6600, and the nut 6700, example embodiments are not limited thereto. For example, rather than providing the above components, the biasing device 6000 may be comprised of an elastic member arranged between the first blade 5220 and the plate 6050. For example, the biasing device 6000 could simply be a spring (for example, a coil spring or a leaf spring) having a first end tack welded (or bolted) to the first blade 5220 and a second end tack welded (or bolted) to the plate 6050.

When installed the biasing device 6000 provides stability to the touch bar 5000. However, because the biasing device 6000 includes a biasing member 6500 which may be relatively flexible, the biasing device 6000 provides very little resistance to movement of the blades of the touch bar 5000 towards the A2B mount 4000 and thus allows the touch bar 5000 to rotate about the screw 4370 in the event the touch bar 5000 is pressed in a direction towards the A2B mount 4000.

In example embodiments, a second biasing device may be installed on another side of the horsehead 100*. The second biasing device may be identical to the biasing device 6000 and may utilize the second blade of the 5320 of the touch bar 5000 and a plate, similar to the plate 6050, on an outside surface of the second plate 4500 of the A2B mount 4000. The second biasing device is not shown for the sake of clarity.

Example embodiments relate to a two-block sensing system (or device) and more particularly a two-block sensing system (or device) attached to an end of a crane. In example embodiments, the two-block sensing system generally comprises an A2B mount connected to an end bracket of a boom via a linkage and connected to a touch bar via a pin connection. The two-block sensing system may or may not include a biasing device to stabilize a position of the touch bar with respect to the A2B mount. However, the inventive concepts are not limited by example embodiments provided above and modifications to example embodiments fall clearly within the scope of the invention.

For example, bolts with clips may be used in lieu of the tear drop pins 250, 250*, and 260. The bolts and clips may, for example, resemble the hitch pin 210 and lynch pin 230.

As a second example modification, the first sheave mounting plate 110 may include a single hole resembling an arc having a center of curvature at hole 111 extending from the fourth hole 114 to the fifth hole 115. The second sheave mounting plate 120 may similarly include a single hole resembling an arc having a center of curvature at hole 121 extending from the fourth hole 124 to the fifth hole 125. In this example, the horsehead is not limited to one of two positions since the horsehead may be fixed at any location along the arc by a fixing mechanism (not shown).

As a third example modification, rather than providing an A2B mount, a linkage, and a touch bar, a plurality of sensors may be arranged on a periphery of the horsehead. Thus, as an object, for example, a hook's pulley block, contacts the plurality of sensors, the contact is sensed. The sensed contact may be transmitted to a controller which controls the crane to stop the motion of the object to avoid damage to the horsehead, cable, and/or object.

As another example, a pivot switch may be added to the horsehead to detect a pivot of the horsehead in the event the horsehead collides with an object, for example, a pulley block. A signal from the pivot switch may be sent to a controller which may control the crane to stop the motion of the object to avoid damage to the horsehead, cable, and/or object.

As yet another example, proximity sensors may be added to the horsehead so that as an object, for example, a pulley block, approaches the horsehead, the object is sensed by the proximity sensor. The proximity sensor may then send a signal to a controller which may control the crane to stop the motion of the object to avoid damage to the horsehead, cable, and/or object.

As yet another example, rather than attaching the A2B mount to an end bracket of the boom, the A2B mount may be connected to the horsehead via a cable which loop over a top of the horsehead. The cable may maintain the A2B mount in a relatively stable position.

As yet another example, the links 600 and 600* may, instead of being bent members, be straight or curved members. In example embodiments, the links are generally provided in pairs, however, in example embodiments, the links in each pair may be different from each other. For example, one link of one pair may be curved and the other link of the pair may be straight.

As yet another example, components may be added to the horsehead to increase its functionality. For example, lights may be attached to the horsehead at various locations, for example, the A2B mount, the touch bar, and the first and second sheave mounting plates.

Example embodiments have been described which are intended in all respects to be illustrative rather than restrictive. Alternative embodiments will become apparent to those of ordinary skill in the art to which the present invention pertains without departing from its scope. From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

We claim:

1. A sensing device comprising:

an A2B mount;

a touch bar pivotally connected to the A2B mount;

a link pivotally connected to the A2B mount to link the A2B mount to a support structure; and a switch operatively connected to the touch bar so that if the touch bar is rotated relative to the A2B mount, the switch becomes one of activated and deactivated.

2. The sensing device of claim 1, wherein the A2B mount includes a first plate and a second plate arranged parallel with the first plate.

3. The sensing device of claim 2, wherein the touch bar includes a backplate, a first tab extending from the backplate, the first tab including a first surface facing an outer surface of the first plate, a second tab extending from the backplate, the second tab including a second surface facing an outer surface of the second plate, and a connector configured to rotatably connect the touch bar and the A2B mount.

4. The sensing device of claim 3, wherein the connector configured to rotatably connect the touch bar and the A2B mount includes a pin.

5. The sensing device of claim 4, wherein the touch bar further includes a pair of blades extending from the back plate, each of the blades including a first portion extending from the backplate and a second portion extending from the first portion.

6. The sensing device of claim 5, wherein the second portion is inclined to the first portion.

7. The sensing device of claim 2, further comprising:

a first pin passing through each of said first plate and said second plate.

8. The sensing device of claim 7, wherein the first pin is a teardrop pin having a body and a flange.

9. The sensing device of claim 7, wherein the link is a pair of links comprising a first link and a second link.

10. The sensing device of claim 9, wherein the first and second links include a bend.

11. The sensing device of claim 9, further comprising:

a connector rotatably connecting the first link to the first plate; and a connector rotatably connecting the second link to the second plate.

12. The sensing device of claim 1, wherein the switch is on the A2B mount.

13. The sensing device of claim 1, further comprising:

a biasing device between the A2B mount and the touch bar to stabilize the touch bar.

14. The sensing device of claim 13, wherein the biasing device includes a plate on the A2B mount; and a biasing member pressing against the plate and the touch bar.

15. The sensing device of claim 14, wherein the biasing member is a spring.

16. A crane comprising:

a horsehead on an end of a boom, the horsehead being configured to flip from a first position to at least one other position;

a sensing device on the horsehead, the sensing device including an A2B mount, a link, and a touch bar, wherein the A2B mount is rotatably connected to the horsehead, the touch bar is rotatably connected to the A2B mount, and the link has a first region and a second region spaced apart from the first region, the first region being rotatably connected to the A2B mount and the second region being rotatably connected to the end of the boom; and a switch operatively connected to the touch bar so that if the touch bar rotates relative to the A2B mount, the switch becomes one of activated and deactivated, wherein flipping the horsehead from the first position to the at least one other position rotates the horsehead about 90 degrees.

17. The crane of claim 16, wherein the switch is on the A2B mount.

18. A kit for retrofitting a crane having a horsehead, the horsehead being configured to be supported by an end of a boom of the crane, the kit comprising:

an A2B mount configured to attach to the horsehead;

at least one link having a first region configured to attach to the A2B mount and a second region configured to extend to the end of the crane, the first and second regions being spaced apart from one another;

a touch bar configured to attach to the A2B mount;

a biasing device configured to attach to the A2B mount and the touch bar; and a switch, wherein the A2B mount includes a first plate and a second plate arranged parallel with the first plate.

19. The kit of claim 18, further comprising:

a means to associate the at least one link with an end bracket of said crane.

20. The kit of claim 18, further comprising:

a means to associate the touch bar with the A2B mount.

21. The kit of claim 18, wherein the at least one link is a pair of links configured to attach to the A2B mount and an end bracket of said crane.

22. The kit of claim 18, further comprisimg:

a means to rotatably associate the A2B mount with the horsehead.

23. The kit of claim 18, further comprising:

instructions for retrofitting said crane to comprise a horsehead configured to flip from a first position to at least one other position and arrange the A2B mount, the at least one link, and the touch bar.

* * * * *